US007959417B1

(12) United States Patent
White, III

(10) Patent No.: US 7,959,417 B1
(45) Date of Patent: Jun. 14, 2011

(54) HYDRAULIC ENGINE

(76) Inventor: Charles A. White, III, San Jose, CA (US)

( * ) Notice: Subject to any disclaimer, the term of this patent is extended or adjusted under 35 U.S.C. 154(b) by 917 days.

(21) Appl. No.: 11/906,879

(22) Filed: Oct. 3, 2007

(51) Int. Cl.
*F04B 17/00* (2006.01)

(52) U.S. Cl. ..... 417/379; 417/380; 417/381; 60/325; 60/595

(58) Field of Classification Search ..... 417/379–381, 417/406; 60/595, 596, 325; 290/54
See application file for complete search history.

(56) References Cited

U.S. PATENT DOCUMENTS 2,473,204 A * 6/1949 Huber ..... 123/46 B
3,046,727 A * 7/1962 Horgen ..... 60/595
3,103,100 A * 9/1963 Hryniszak ..... 60/595
3,119,230 A * 1/1964 Kosoff ..... 60/595
3,983,699 A 10/1976 Hanis
4,097,198 A 6/1978 Herron
4,481,772 A * 11/1984 Benaroya ..... 60/595
4,966,000 A * 10/1990 Wolters ..... 60/595
6,551,076 B2 4/2003 Boulware

* cited by examiner

*Primary Examiner* — Charles G Freay
*Assistant Examiner* — Todd D Jacobs

(57) ABSTRACT

The hydraulic engine includes first and second reaction chambers, the first and second reaction chambers each having an enclosure within which is disposed a floating piston. An impulse turbine is in fluid communication with the first and second reaction chambers. A delay valve is in fluid communication with the first and second reaction chambers and the impulse turbine, the delay valve operable to switch between a first position and a second position, the first position providing a flow of pressurized fluid to the first reaction chamber to cause an explosion therein and the second position providing a flow of pressurized fluid to the second reaction chamber to cause an explosion therein. Successive explosions in the first and second reaction chambers provide flows of high pressure fluid to drive the impulse turbine and to switch the delay valve.

20 Claims, 18 Drawing Sheets

HYDRAULIC ENGINE

BACKGROUND OF THE INVENTION

The present invention relates generally to engines and more particularly to a high efficiency hydraulic engine.

Engine efficiency continues to be a primary concern in engine design particularly given limited supplies of hydrocarbon fuel, detrimental effects of hydrocarbon pollution, and increasing costs of extracting hydrocarbon fuel. Current engines including internal combustion engines and diesel engines suffer many disadvantages including piston ring and cylinder wear, heat loss, and specific compression ratios. Internal combustion or pressurized gas assisted hydraulic engines have been proposed in the art to provide more efficient energy conversion. However, conventional designs disadvantageously include pistons and cylinders.

A hydraulic engine is disclosed in U.S. Pat. No. 3,983,699. An is oil pressure chamber is coupled to the input of a turbine for driving the turbine with hydraulic fluid under pressure. A lower cylinder has a piston movably mounted therein for movement in axial directions. The output end of the lower cylinder is coupled to the oil pressure chamber. An upper cylinder has a piston movably mounted therein for movement in axial directions and coupled to the piston of the lower cylinder for movement therewith. A hydraulic fluid supply is coupled to the output end of the lower cylinder for supplying hydraulic fluid to the lower cylinder. A fuel and air mixture supply is coupled to the output end of the upper cylinder for supplying a fuel and air mixture to the upper cylinder. A coupling device couples the output end of the upper cylinder to the input end of the lower cylinder whereby movement of the piston from the input end to the output end in the upper cylinder compresses the fuel and air mixture and supplies it to the input end of the lower cylinder. A spark device in the input end of the lower cylinder explodes the fuel and air mixture in the lower cylinder thereby moving the piston thereof from the input end to the output end to compress the hydraulic fluid in the output end thereof and supply it to the oil pressure chamber and thence to the turbine to drive the turbine.

U.S. Pat. No. 4,097,198 discloses an internal combustion assisted hydraulic engine. The engine utilizes two sets of hydraulic cylinders connected to a shaft so as to be alternately pressurized as the shaft is reciprocally driven by a pair of conventional internal combustion chambers. The outlets of all hydraulic cylinders are connected to a common output line via valves. During each power stroke certain of the hydraulic cylinders being pressurized are selectively disconnected (depressurized) from the output line. This effectively decreases the load on the driving chamber, and insures a relatively constant, high pressure hydraulic fluid output level despite changes in supplied force during each power stroke. The selective cylinder disconnection may be implemented programmatically in response to changes in engine parameters such as combustion pressure.

A fuel/hydraulic engine system is disclosed in U.S. Pat. No. 6,551,076. A fuel engine having a cylinder and piston includes a fuel injector, a spark plug, and an intake valve controlled by an intake solenoid. A fuel engine piston is physically located and attached by a shaft to a hydraulic work piston.

What is needed is a hydraulic engine that overcomes the disadvantages of the prior art. What is also needed is a hydraulic engine that has a floating piston. What is further needed is a hydraulic engine that does not require a cooling system.

What is also needed is a hydraulic engine that provides for an increased number of turbine shaft revolutions per combustion chamber explosion.

SUMMARY OF THE INVENTION

In accordance with one aspect of the invention, a hydraulic engine includes first and second reaction chambers, the first and second reaction chambers each having an enclosure within which is disposed a floating piston. An impulse turbine is in fluid communication with the first and second reaction chambers and a delay valve. The delay valve is operable to switch between a first position and a second position, the first position providing a flow of pressurized fluid to the first reaction chamber to cause an explosion therein and the second position providing a flow of pressurized fluid to the second reaction chamber to cause an explosion therein. Successive explosions in the first and second reaction chambers provide flows of high pressure fluid to drive the impulse turbine and to switch the delay valve. A pressure tank is in fluid communication with the first and second reaction chambers, the impulse turbine and the delay valve, the pressure tank providing pressurized fluid to the first and second reaction chambers, the impulse turbine and the delay valve.

In accordance with another aspect of the invention, a hydraulic engine includes first and second reaction chambers, the first and second reaction chambers each having an enclosure within which is disposed a floating piston. The first and second reaction chambers further each include an exhaust valve and an air intake valve and a fuel pump. An impulse turbine is in fluid communication with the first and second reaction chambers and a delay valve. The delay valve is operable to switch between a first position and a second position, the first position providing a flow of pressurized fluid to the first reaction chamber to cause an explosion therein and the second position providing a flow of pressurized fluid to the second reaction chamber to cause an explosion therein. Successive explosions in the first and second reaction chambers provide flows of high pressure fluid to drive the impulse turbine and to switch the delay valve. A delay valve actuated switch is mechanically coupled to the delay valve, the delay valve actuated switch operable to switch the exhaust and air intake valves and the fuel pumps coupled to the first and second reaction chambers. A pressure tank is in fluid communication with the first and second reaction chambers, the impulse turbine and the delay valve, the pressure tank providing pressurized fluid to the first and second reaction chambers, the impulse turbine and the delay valve.

In accordance with yet another aspect of the invention, a hydraulic engine includes first and second reaction chambers, the first and second reaction chambers each having an enclosure within which is disposed a floating piston. First and second reaction chambers each include an exhaust valve and an air intake valve and a fuel pump. An impulse turbine is in fluid communication with the first and second reaction chambers and a delay valve. The delay valve is operable to switch between a first position and a second position, the first position providing a flow of pressurized fluid to the first reaction chamber to cause an explosion therein and the second position providing a flow of pressurized fluid to the second reaction chamber to cause an explosion therein. Successive explosions in the first and second reaction chambers provide flows of high pressure fluid to drive the impulse turbine and to switch the delay valve. A delay valve actuated switch is mechanically coupled to the delay valve, the delay valve actuated switch operable to switch the exhaust and air intake valves and the fuel pumps coupled to the first and second reaction chambers. The delay valve actuated switch is further operable to switch between a first and a second position corresponding to the first and second positions of the delay valve. The delay valve actuated switch first position provides a DC current to open the second reaction chamber exhaust valve and a DC current to close the first reaction chamber exhaust and air intake valves. The delay valve actuated switch second position provides a DC current to open the first reaction chamber exhaust valve and a DC current to close the second reaction chamber exhaust and air intake valves. A pressure tank is in fluid communication with the first and second reaction chambers, the impulse turbine and the delay valve, the pressure tank providing pressurized fluid to the first and second reaction chambers, the impulse turbine and the delay valve.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the arrangement of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent methods and systems insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings wherein.

DETAILED DESCRIPTION OF THE INVENTION

Overview of Hydraulic Engine Components and Operation

The hydraulic engine of the invention will now be described in general terms and with reference to FIG. 1. The detailed functioning of the hydraulic engine as well as the details of construction and operation of the various components thereof and the interconnections there between will be described with particular reference to FIGS. 2A through 15B.

Figure 1:
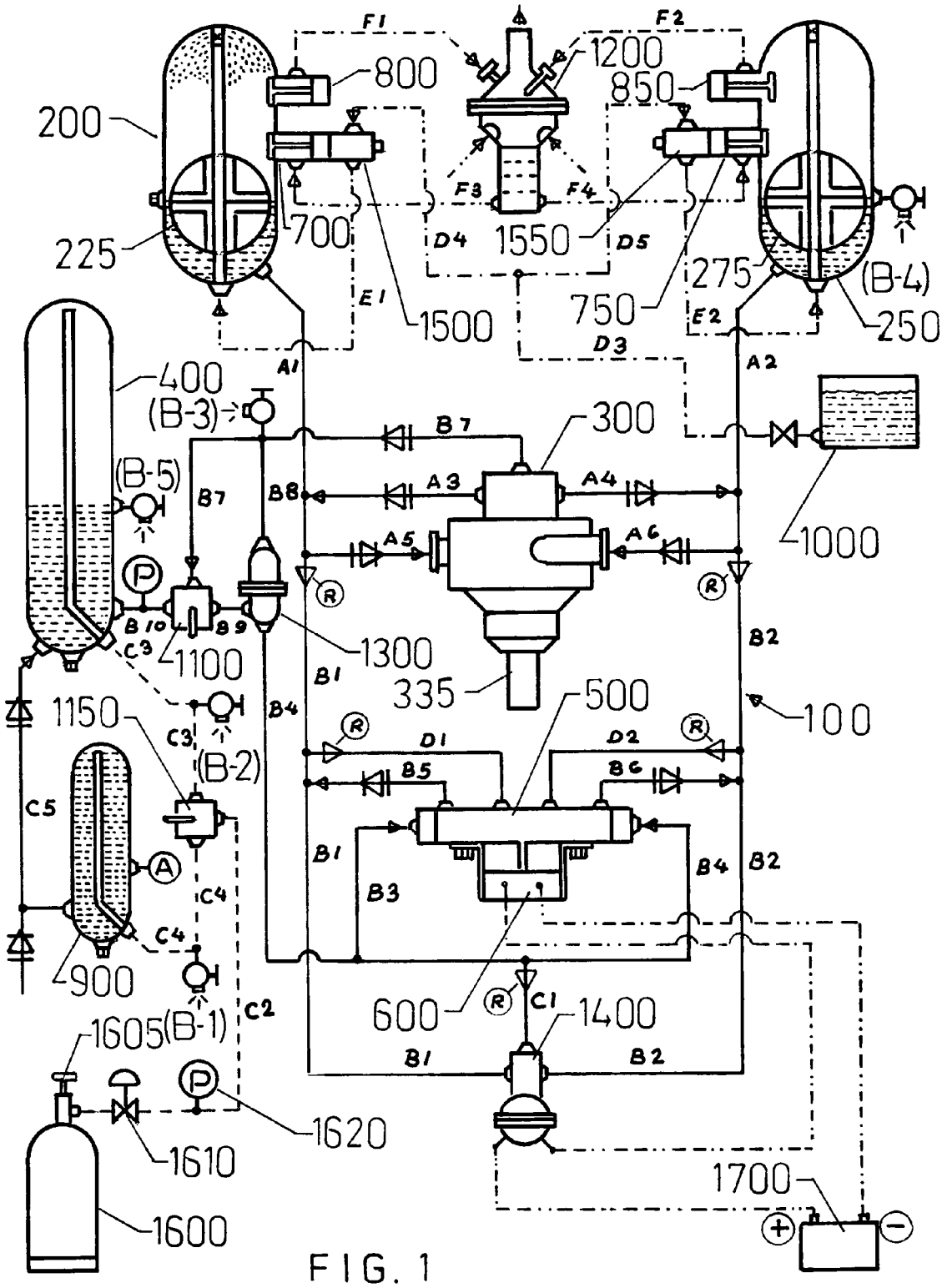
FIG. 1 is a schematic representation of the hydraulic engine in accordance with the invention.

With reference to FIG. 1, a hydraulic engine generally designated 100 includes an impulse turbine 300 hydraulically coupled to first and second reaction chambers 200 and 250 respectively. In operation, sequenced explosions in the first and second reaction chambers 200 and 250, ignited by compressing a fuel/air mixture therewithin, are operable to hydraulically drive the impulse turbine 300. Rotation of a plurality of turbine blades provides a torque to a shaft 335 of the impulse turbine 300.

The hydraulic engine 100 includes a hydraulic system, a fuel/air system and an electrical system. The hydraulic system includes a source of pressurized hydraulic fluid, which in the preferred embodiment is water, stored in a pressure tank 400. The hydraulic system further includes a plurality of valves and check valves, a make-up tank 900, and conduits hydraulically coupling the various components of the hydraulic system as further described herein.

A hydraulically actuated delay valve 500 is operable to switch a flow of pressurized fluid between the first and second reaction chambers 200 and 250. Delay valve 500 also provides a delay in the flow of pressurized fluid to the reaction chambers 200 and 250 such that exhaust gases in each reaction chamber are replaced with the fuel/air mixture before compression.

In a first position of the delay valve 500, flow of pressurized fluid to the first reaction chamber 200 urges a floating piston 225 disposed inside the first reaction chamber 200 upward to compress and ignite the fuel/air mixture. The resulting explosion drives the impulse turbine 300 and causes a flow of high-pressure fluid to switch the delay valve 500 to a second position in which the flow of pressurized fluid is directed to the second reaction chamber 250.

In a second position of the delay valve 500, the flow of pressurized fluid to the second reaction chamber 250 urges a floating piston 275 disposed inside the second reaction chamber 250 upward to compress the fuel/air mixture therein. Compression of the fuel/air mixture ignites the fuel/air mixture and causes an explosion. The resulting explosion drives the impulse turbine 300 and causes a flow of high-pressure fluid to switch the delay valve 500 back to the first position in which the flow of pressurized fluid is directed to the first reaction chamber 200. Thus sequential explosions in each of the first and second reaction chambers 200 and 250 drive the impulse turbine 300.

The fuel/air system is operable to sequentially provide the fuel/air mixture to the first and second reaction chambers 200 and 250 and includes a fuel tank 1000, fuel pumps 1500 and 1550, an air pump 1200, air intake valves 700 and 750, and exhaust valves 800 and 850. Fuel pumps 1500 and 1550, air intake valves 700 and 750, and exhaust valves 800 and 850 are actuated by the electrical system. Exhaust gases exiting the reaction chambers 200 and 250 actuate the air pump 1200.

The electrical system includes an electrical circuit having a battery 1700 electrically coupled to a switch 600. The electrical system is operable to energize the air intake valve and the exhaust valve of each reaction chamber 200 and 250. Hydraulically actuated delay valve 500 actuates the switch 600 between first and second positions. In a second position of the switch 600 corresponding to the second position of the delay valve 500, the air intake valve 700 and the exhaust valve 800 of the first reaction chamber 200 are opened while the air intake valve 750 and the exhaust valve 850 of the second reaction chamber 250 are closed. Closing the air intake valve 750 of the second reaction chamber 250 actuates the fuel pump 1550 of the second reaction chamber 250 to provide fuel to the second reaction chamber 250. While the air intake valve 750 and the exhaust valve 850 of the second reaction chamber 250 are closed, increasing fluid pressure in the second reaction chamber 250 urges the floating piston 275 upward to compress the fuel/air mixture and thereby ignite it. The resulting explosion then causes the flow of high-pressure fluid to switch the delay valve 500 back to the first position in which the flow of pressurized fluid is directed to the first reaction chamber 200. Switching of the delay valve 500 also switches the switch 600 to a first position.

In a first position of the switch 600, the exhaust valve 850 of the second reaction chamber 250 is opened while the air intake valve 700 and the exhaust valve 800 of the first reaction chamber 200 are closed. The air intake valve of the second reaction chamber 250 remains closed due to high pressure within the second reaction chamber 250. The exhaust gases in the second reaction chamber 250 exit the second reaction chamber 250 through the open exhaust valve 850 and the air intake valve 750 opens when the pressure within the second reaction chamber 250 is sufficiently reduced. Air then enters the second reaction chamber 250 through the open air intake valve 750.

Closing the air intake valve 700 of the first reaction chamber 200 actuates the fuel pump 1500 of the first reaction chamber 200 to provide fuel to the first reaction chamber 200. While the air intake valve 700 and the exhaust valve 800 of the first reaction chamber 200 are closed, increasing fluid pressure in the first reaction chamber 200 urges the floating piston 225 in the first reaction chamber 200 upward to compress the fuel/air mixture and thereby ignite it. The resulting explosion then causes the flow of high-pressure fluid to switch the delay valve 500 back to the second position in which the flow of pressurized fluid is directed to the second reaction chamber 250. Switching of the delay valve 500 also switches the switch 600 to a second position and the sequence repeats itself until shut off.

Two three position rotary valves 1100 and 1150 provide for control of the hydraulic engine 100. Three position rotary valve 1100 is operable to start, stop and restart the hydraulic engine 100 while three position rotary valve 1150 is operable to provide high pressure gas to the pressure tank 400 and the make-up tank 900 from a gas tank 1600.

The hydraulic system of the hydraulic engine 100 further includes a hydraulically actuated shut-off valve 1300 and a hydraulically actuated bypass valve 1400. By-pass valve 1400 is operable to equalize the pressure between the first and second reaction chambers 200 and 250 when the hydraulic engine 100 is shut off as well as to open the electrical circuit of the hydraulic engine 100.

Having described in general terms the operation of the hydraulic engine 100 of the invention, each of the various components of the hydraulic engine 100 will now be described in detail.

The Reaction Chambers

Figure 2C:
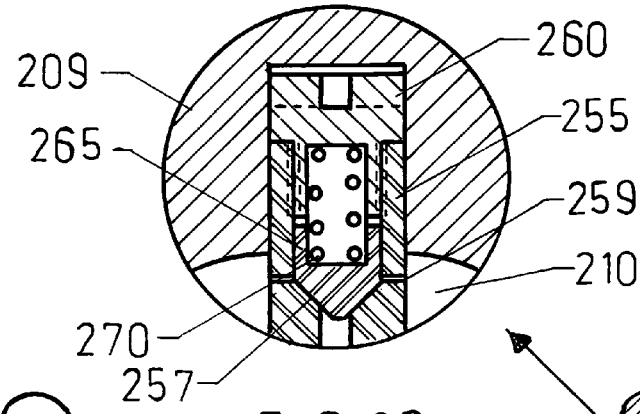
FIG. 2C is a cross sectional view of a fuel atomizer in accordance with the invention.
Figure 2A:
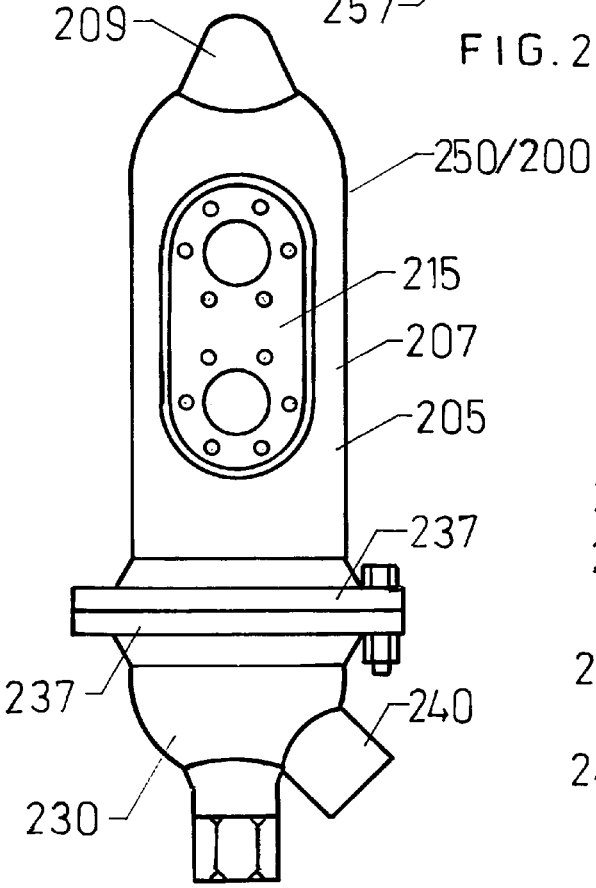
FIG. 2A is a side elevation view of a first reaction chamber in accordance with the invention.
Figure 2B:
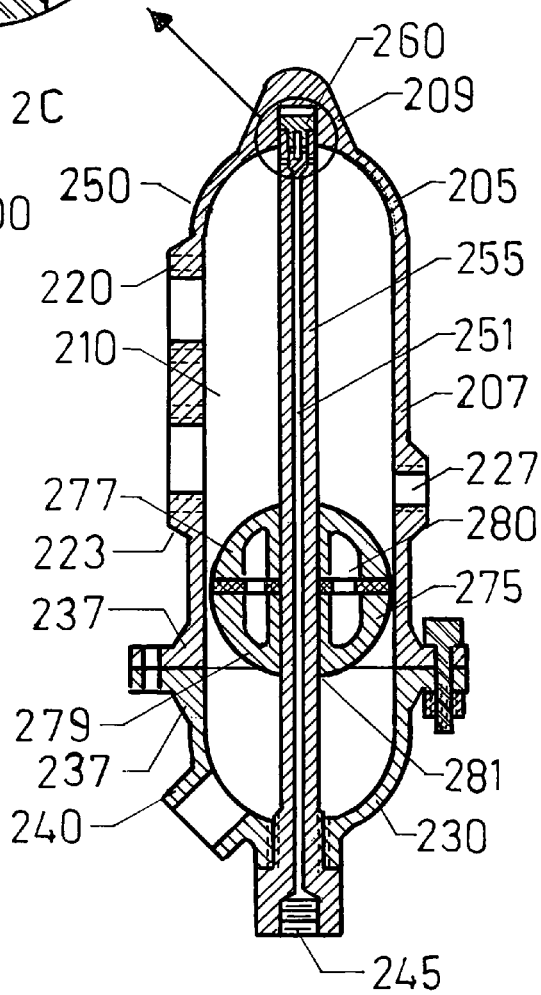
FIG. 2B is a cross sectional view of the first reaction chamber shown in FIG. 2A.

With reference to FIG. 2A, FIG. 2B and FIG. 2C, the reaction chamber 250 will now be described. Reaction chamber 200 is identical in all respects to reaction chamber 250 with the exception that reaction chamber 200 does not include a bleeder valve B-4 (FIG. 1).

Reaction chamber 250 includes a body 205 of generally cylindrical shape defining an enclosure 210 therewithin. The body 205 includes a top portion 207 and a bottom portion 230 coupled at flanges 237. A plate 215 in the top portion 207 may be provided to enable access to the enclosure 210. The plate 215 is welded to the top portion 207. Flanged connection points 220 and 223 are formed in the top portion 207 of the body 205 to receive the exhaust valve 850 and the air intake valve 750 respectively. Details of construction and operation of the exhaust valve 850 will be described with reference to FIG. 8A and FIG. 8B while those of the air intake valve 750 will be described with reference to FIG. 7A and FIG. 7B.

Top portion 207 further includes a screw connection point 227 sized and configured to receive the bleeder valve B-4 (FIG. 1). Bleeder valve B-4 is operable to provide a means of bleeding the first and second reaction chambers 200 and 250 of air during initialization of the hydraulic engine 100 as further described herein.

Bottom portion 230 of the body 205 includes a flanged connection point 240 for providing fluid communication between the enclosure 210 and a pipe A2 through which pressurized fluid flows into and out of the reaction chamber 250. Pipe A2 may include a three-inch diameter pipe coupled to the flanged connection point 240.

Bottom portion 230 of the body 205 further includes a screw connection point 245 for connection to a one eighth inch fuel line E2 coupled to the fuel pump 1550 (FIG. 1). Fuel from the fuel line E2 communicates with an interior 251 of a pipe 255 that extends through the enclosure 210 and terminates at a fuel atomizer 260.

The fuel atomizer 260 is preferably formed in a top 209 of the top portion 207 of the second reaction chamber 250 and includes a valve body 265 that seats in a seat 257 bored in a top of the pipe 255. A spring 270 urges the valve body 265 against the seat 257 to close off fluid communication between the interior 251 of the pipe 255 and a plurality of holes 259 formed in the pipe 255. Fluid pressure in the pipe 255 provided by the fuel pump 1550 is operable to urge the valve body 265 against the spring 270 and provide an outlet for the fuel through the plurality of holes 259. The plurality of holes 259 are sized to atomize the pressurized fuel exiting the plurality of holes 259 into the enclosure 210.

The floating piston 275 is comprised of two hemispherical sections 277 and 279 joined and cemented together and having a vacuum formed in an interior 280 thereof. The two sections 277 and 279 are formed such that the outside diameter of the floating piston 275 is substantially equal to the inside diameter of the enclosure 210 along a substantial length thereof. The floating piston 275 further comprises a cylindrical hole 281 formed there through in surrounding relationship with the pipe 255. The floating piston 275 rises and falls along the pipe 255 with the rising and falling level of the pressurized fluid in the enclosure 210 and separates the pressurized fluid in the bottom of the enclosure 210 to compress the fuel/air mixture in the top of the enclosure 210.

The Impulse Turbine

Figure 3C:
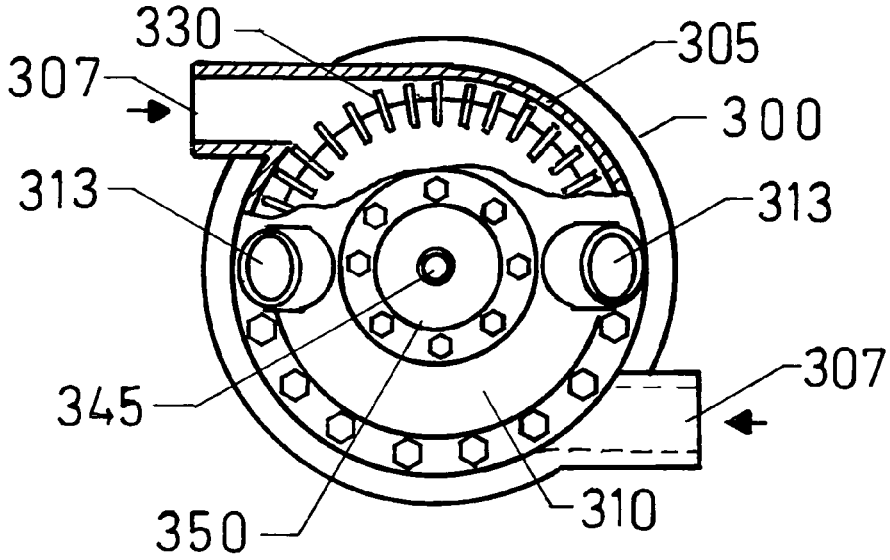
FIG. 3C is a top view in partial cross section of the impulse turbine shown in FIG. 3A.
Figure 3A:
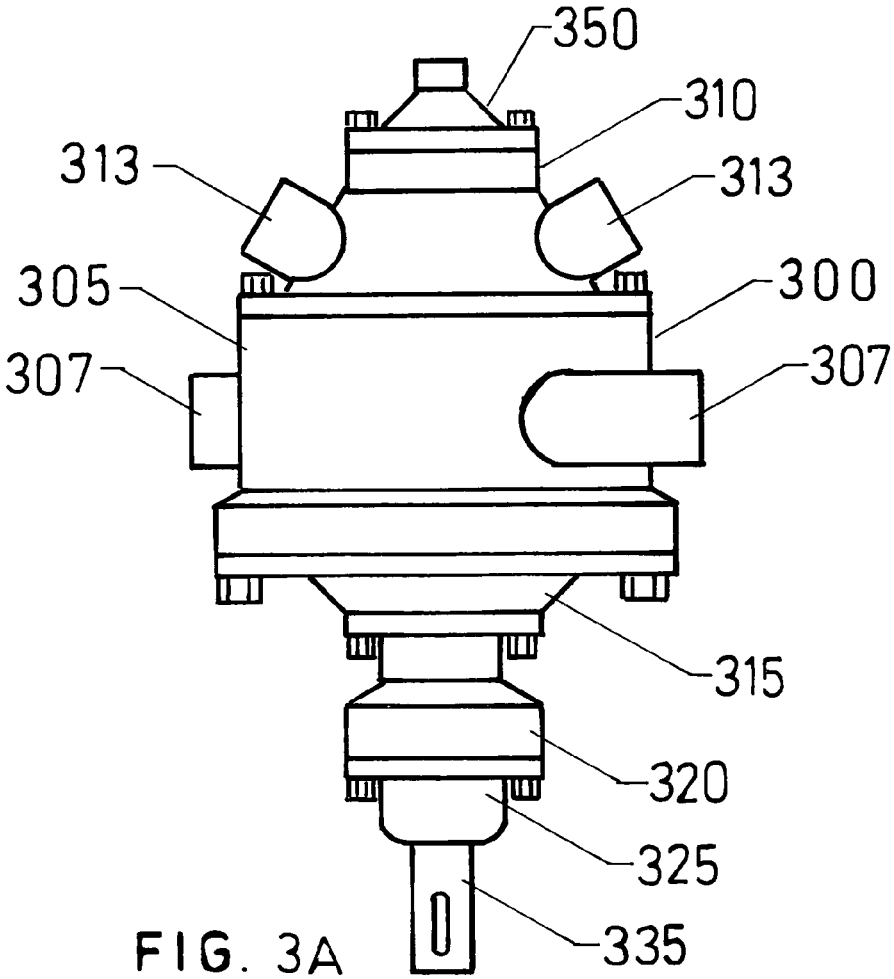
FIG. 3A is a side elevation view of an impulse turbine in accordance with the invention.
Figure 3B:
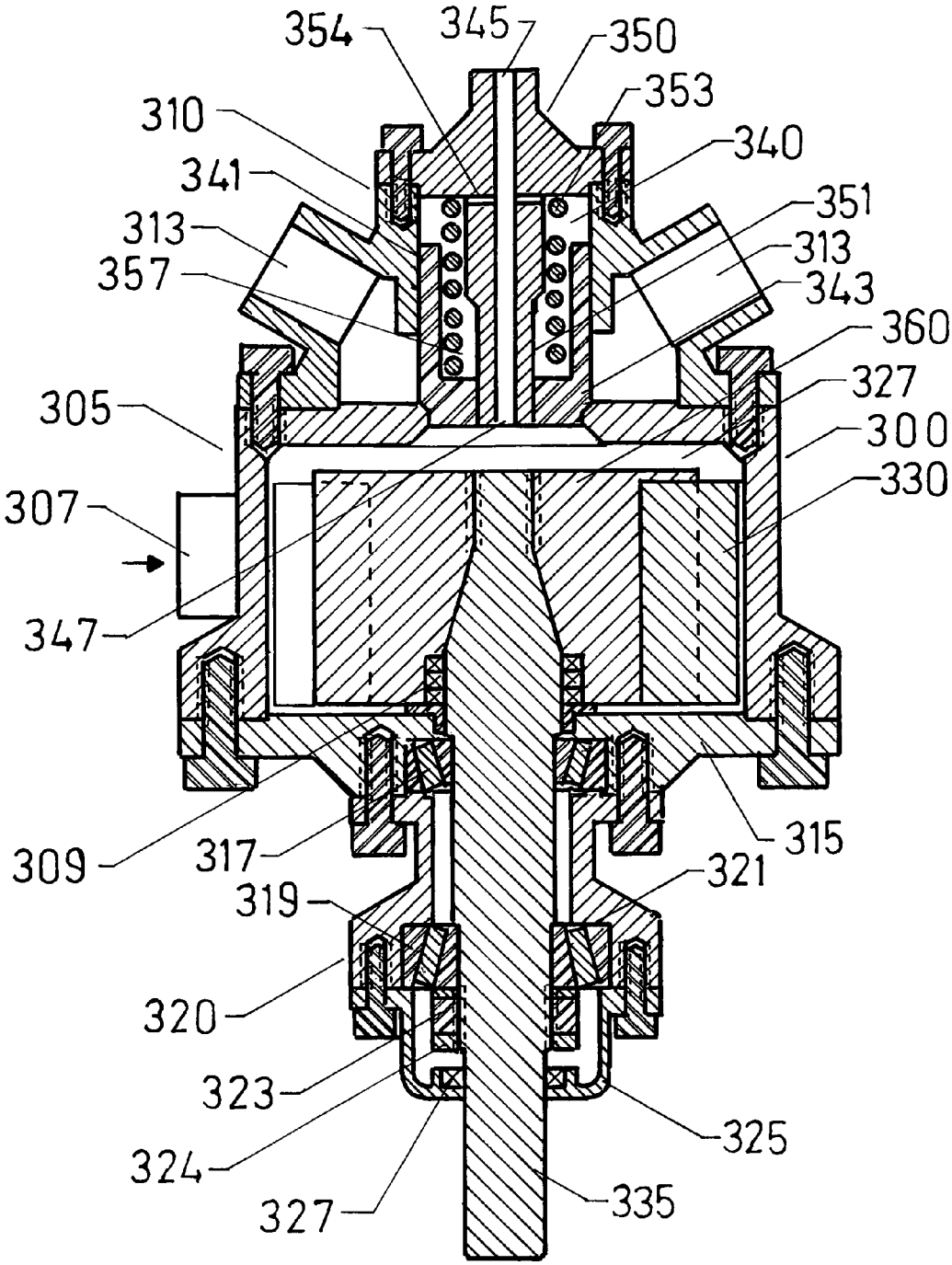
FIG. 3B is a cross sectional view of the impulse turbine shown in FIG. 3A.

The impulse turbine 300 is shown in FIG. 3A, FIG. 3B and FIG. 3C and includes a main housing 305, a turbine cover 310, a bearing plate 315, a bearing holder 320, and a bearing cover 325. Main housing 305, the turbine cover 310, and the bearing plate 315 define a turbine enclosure 327 within which are disposed a turbine rotor 360 having attached thereto a plurality of turbine blades 330. Turbine shaft 335 is attached to the turbine rotor in a conventional manner.

Fluid flow into the turbine enclosure 327 imparts a rotational force upon the shaft 335 when pressurized fluid flows into the turbine enclosure 327 through inlets 307 formed in the main housing 305 and out of the turbine enclosure 327 through outlets 313 formed in the turbine cover 310. Inlets 307 are coupled to the reaction chambers 200 and 250 by three inch pipes A5 and A6 respectively. Outlets 313 are coupled to the reaction chambers 200 and 250 by three inch pipes A3 and A4 respectively. A mechanical seal 309 seals the shaft 335 at a bearing plate interface and prevents pressurized fluid from escaping the turbine enclosure 327 other than through the outlets 313.

Bearing plate 315 is bolted to the main housing 305 and houses a first bearing 317. Bearing holder 320 is bolted to the bearing plate 315 and houses a second bearing 319. First and second bearings 317 and 319 cooperate to enable rotation of the shaft 335 within the impulse turbine 300. First bearing 317 is held against the bearing plate 315 by the bearing holder 320 and the second bearing 319 is held against a shoulder 321 of the bearing holder 320 by a nut 323 and a locking nut 324. Bearing cover 325 is bolted to the bearing holder 320 to provide a clean environment to the second bearing 319 and an oil seal 327 prevents lubricant from exiting the bearing cover 325.

A check valve 340 is disposed within the turbine cover 310 and includes a valve body 341 of hollowed cylindrical configuration having a bottom portion 343. An aperture 347 is formed in the bottom portion 343 for slidingly receiving a bottom portion 351 of a cover flange 350 bolted to the turbine cover 310. The cover flange 350 has an opening 345 extending through the length thereof and provides fluid communication between the turbine enclosure 327 and a pipe B7 coupled to the cover flange 350. Pipe B7, which may include a one inch pipe, returns pressurized fluid to the pressure tank 400 through the three position valve 1100.

Increased fluid pressure within the turbine enclosure 327 urges the valve body 341 against a spring 353 opening a fluid passageway to the outlets 313 from the turbine enclosure 327. An aperture 354 formed in the body of the cover flange 350 provides for pressure equalization between the turbine enclosure 327 and an enclosure 357 having disposed therein the spring 353.

The Pressure Tank

Figure 4C:
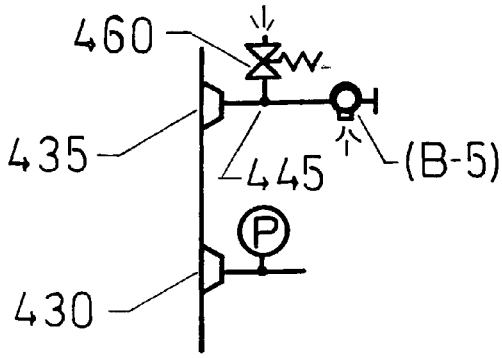
FIG. 4C is a schematic representation of the fittings of the pressure tank shown in FIG. 4A.
Figure 4A:
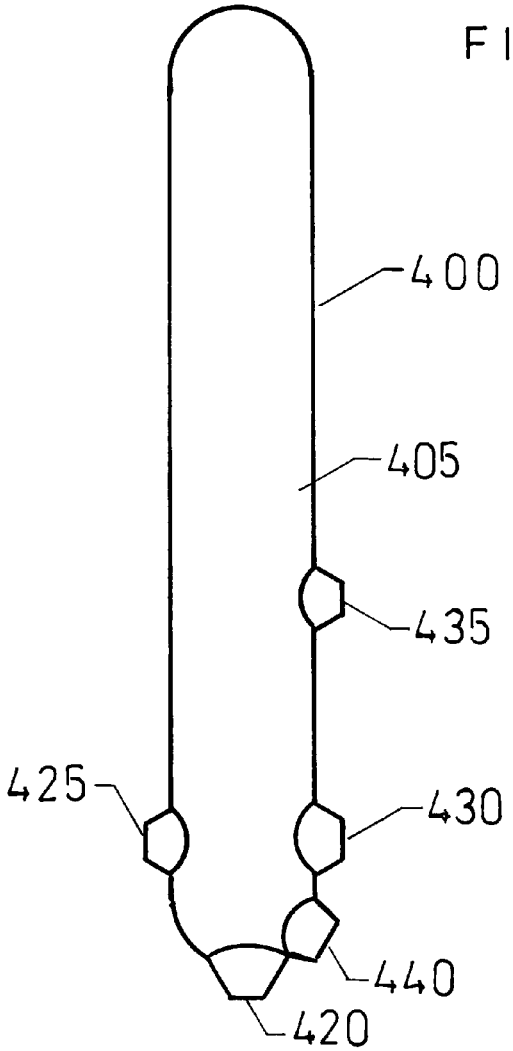
FIG. 4A is a side elevation view of a pressure tank in accordance with the invention.
Figure 4B:
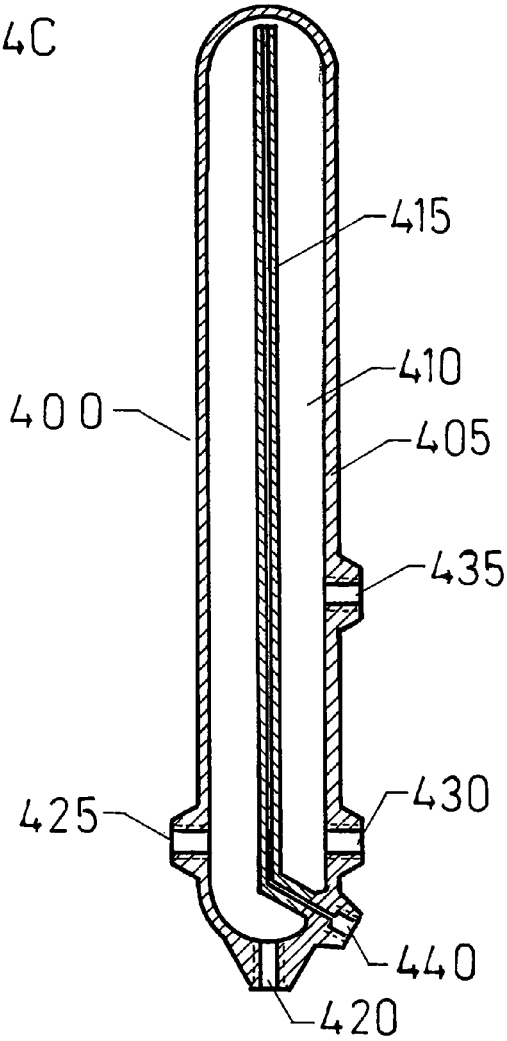
FIG. 4B is a cross sectional view of the pressure tank shown in FIG. 4A.

With reference to FIG. 4A, FIG. 4B and FIG. 4C, the pressure tank 400 includes a body 405 of cylindrical configuration surrounding an enclosure 410. The pressure tank 400 includes a gas inlet 440 in fluid communication with a pipe 415 disposed within the enclosure 410. Gas inlet 440 is connected to the second three position valve 1150 by means of a half inch pipe C3. The pipe 415 extends substantially the length of the enclosure 410 terminating proximate a top thereof. Gas from the gas tank 1600 is provided to the pressure tank 400 through the pipe 415 to pressurize the fluid therein. The second three position valve 1150 provides for regulation of the flow of gas into the enclosure 410 and is connected to the gas tank 1600 by means of a half inch pipe C2.

Hydraulic fluid is provided to the pressure tank 400 through an inlet 425. A source of hydraulic fluid provided by a half inch pipe C5 and the outlet of the make-up tank 900 are coupled to the inlet 425. The source of hydraulic fluid is used to provide an initial volume of hydraulic fluid to the pressure tank 400 while the make-up tank 900 restores hydraulic fluid to the pressure tank 400 lost during operation of the hydraulic engine 100.

An outlet 430 disposed proximate a bottom of the pressure tank 400 is coupled to the first three-way valve 1100 by means of a one inch pipe B10. During operation of the hydraulic engine 100, pressurized hydraulic fluid flows out of and into the pressure tank 400 through the outlet 430 as further described herein. A pressure gauge P in fluid communication with the pressurized fluid in the enclosure 410 provides a means of gauging the pressure of the hydraulic fluid in the pressure tank 400.

A relief valve 460 and a bleeder valve B-5 in fluid communication with the enclosure 410 at an outlet 435 provide pressure relief in case the pressure in the enclosure 410 exceeds a specified value and a means of bleeding fluid from the enclosure 410 respectively. An outlet 420 provides a means of draining the hydraulic fluid from the pressure tank 400.

The Hydraulically Actuated Delay Valve

Figure 5A:
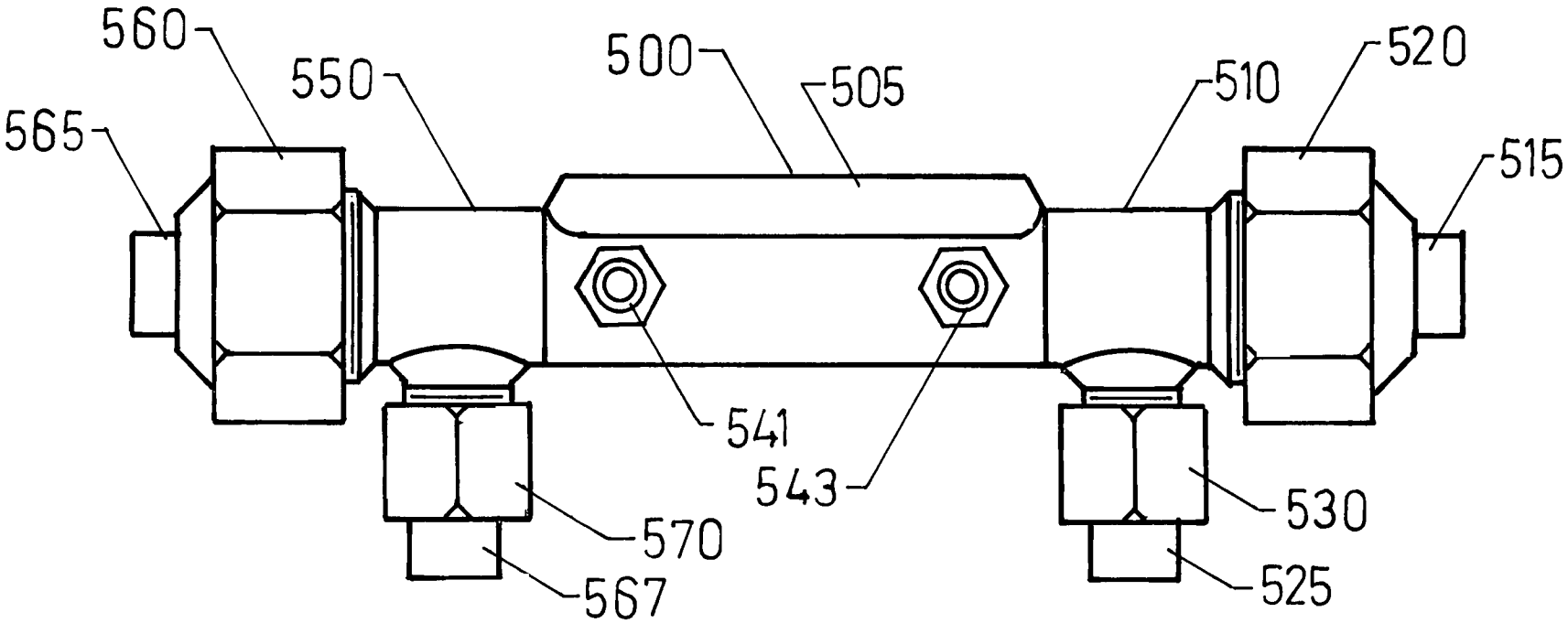
FIG. 5A is a side elevation view of a delay valve in accordance with the invention.
Figure 5B:
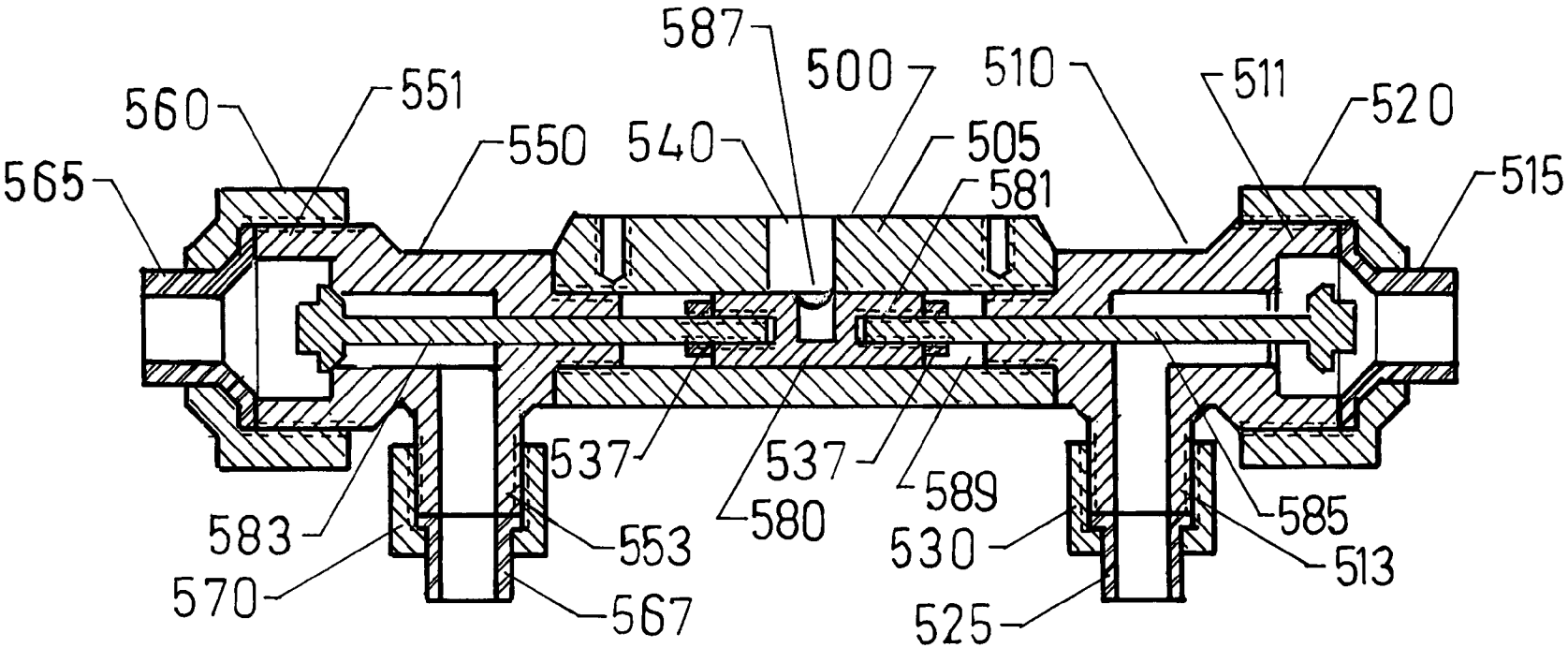
FIG. 5B is a cross sectional of the delay valve of FIG. 5A.

The hydraulically actuated delay valve 500 is shown in FIG. 5A and FIG. 5B and includes a main body 505 to which are attached left and right body sections 550 and 510. Left body section 550 comprises an elbow having a first end 551 to which is attached a one inch pipe B3 in fluid communication with the pressure tank 400 through the shut off valve 1300. The pipe B3 is attached to the first end 551 by means of a nut 560. A one inch pipe B5 is attached to a second end 553 of the left body section 550 in fluid communication with the first reaction chamber 200 through a check valve. The pipe B5 is attached to the second end 553 by means of a nut 570.

Right body section 510 comprises an elbow having a first end 511 and a second end 513. A one inch pipe B4 is attached to the first end 511 in fluid communication with the pressure tank 400 through the shut off valve 1300. The pipe B4 is attached to the first end 511 by means of a nut 520. A one inch pipe B6 is attached to the second end 513 in fluid communication with the second reaction chamber 250 through a check valve. The pipe B6 is attached to the second end 513 by means of a nut 530.

A sliding assembly 580 includes a sliding connector 581 to which are affixed left and right valves 583 and 585 by means of lock nuts 537. Sliding connector 581 moves back and forth within an enclosure 589 formed within the main body 505 and bounded by the left and right body sections 550 and 510. Sliding connector 581 includes a notch 587 accessible through an opening 540 formed in the main body 505. Notch 587 is sized to accept a push rod 690 coupled to the delay valve actuated switch 600 (FIG. 6).

Sliding connector 581 partitions the enclosure 589 into a left section and a right section. Pipe B3 is coupled to the main body 505 in fluid communication with the left section and the pipe B4 is coupled to the main body 505 in fluid communication with the right section. Pipe B5 is coupled in fluid communication with the first reaction chamber 200 and pipe B6 is coupled in fluid communication with the second reaction chamber 250.

Following an explosion in the first reaction chamber 200, high pressure fluid flows through a quarter inch pipe D1 and pushes the sliding connector 581 to thereby close valve 583 and open valve 585. Opening valve 585 allows flow of pressurized fluid through the right body section 510 from the pressure tank 400 to the second reaction chamber 250. Following an explosion in the second reaction chamber 250, high pressure fluid flows through a quarter inch pipe D2 and pushes the sliding connector 581 to thereby close valve 585 and open valve 583. Opening valve 583 allows flow of pressurized fluid through the left body section 550 from the pressure tank 400 to the first reaction chamber 200.

As noted previously, the delay valve 500 provides a delay in the flow of pressurized fluid from the pressure tank 400 to the first and second reaction chambers 200 and 250 following the explosion in each chamber. This delay allows the exhaust gases in the reaction chambers to exit the reaction chamber before the next explosion. In addition, movement of the sliding connector 581 provides movement to the attached push rod 690 to provide the switching of the switch 600.

The Delay Valve Actuated Switch

Figure 6B:
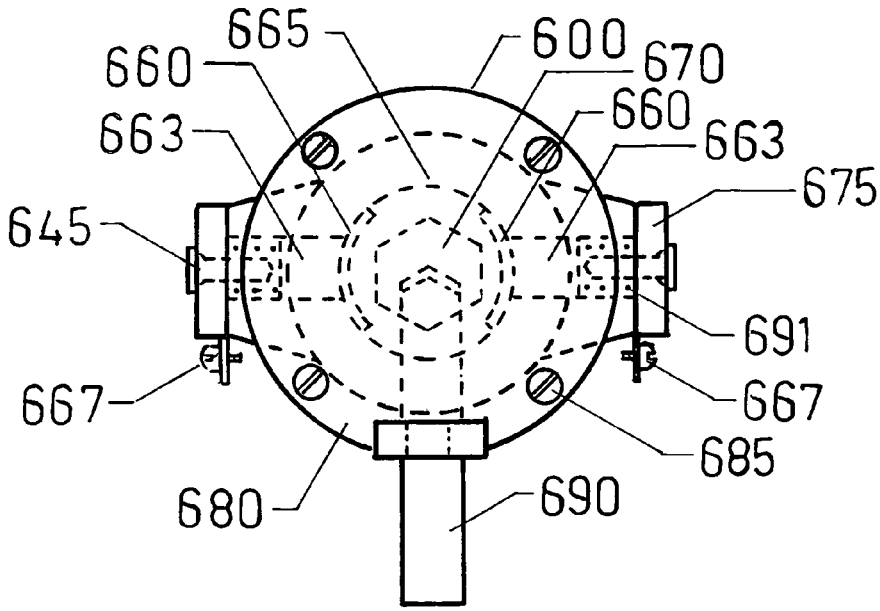
FIG. 6B is an end view of the delay valve actuated switch of FIG. 6A showing several features in phantom.
Figure 6A:
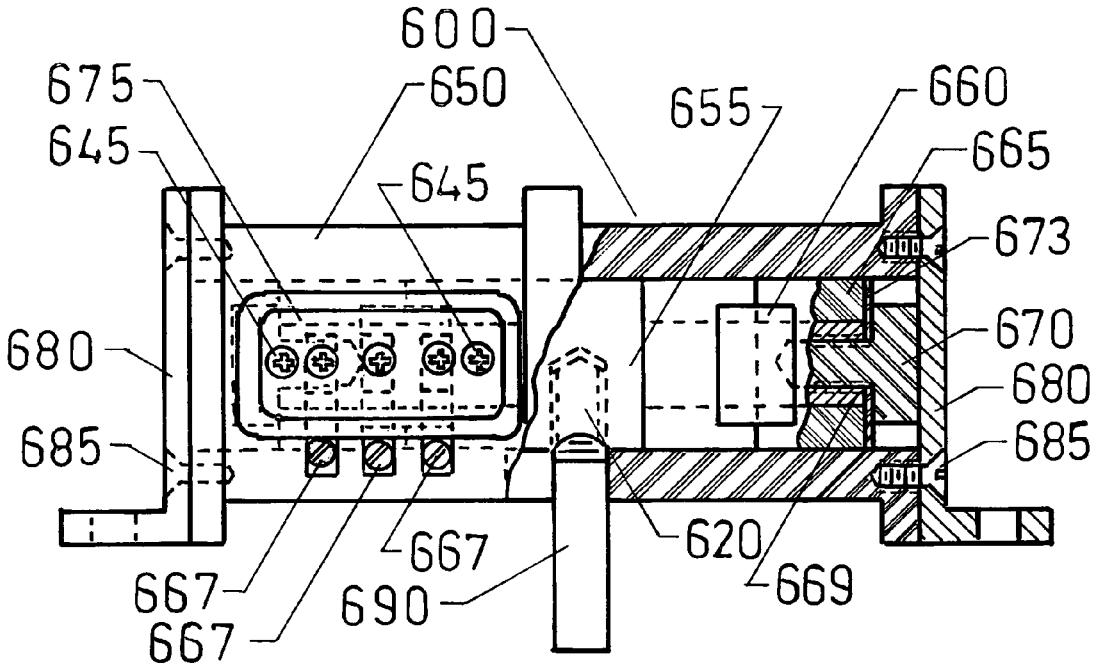
FIG. 6A is a side elevation view in partial cross section of a delay valve actuated switch in accordance with the invention.
Figures 10A, 10C:
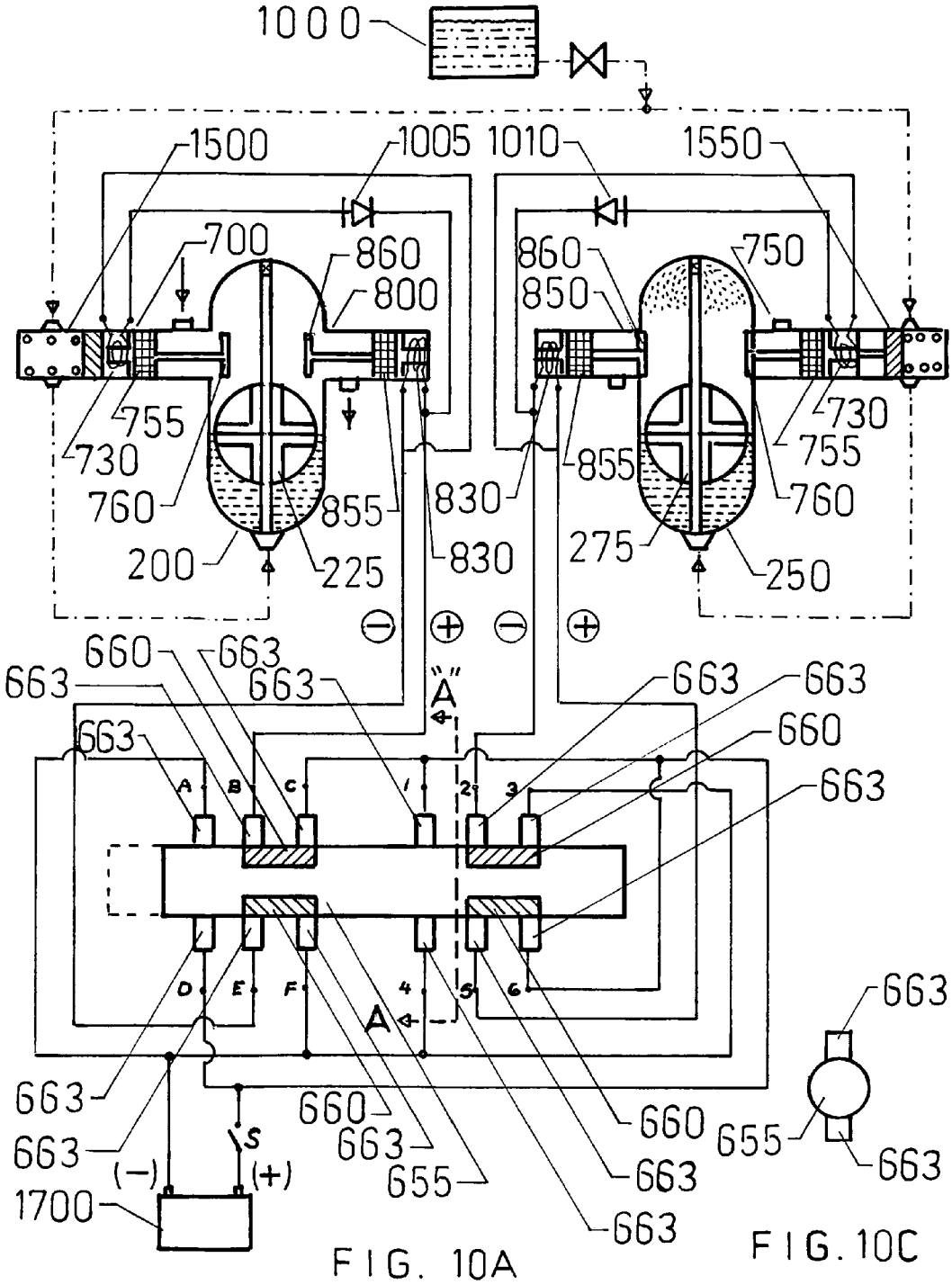
FIG. 10A is a schematic representation of the electrical system showing the delay valve actuated switch in a second position in accordance with the invention.
FIG. 10C is a cross sectional view of a plunger taken along line A-A of FIG. 10A.

The delay valve actuated switch 600 is shown in FIG. 6A and FIG. 6B and includes a body 650 of cylindrical configuration, within which is disposed a cylindrical plunger 655 of non-conductive material having two pairs of opposed conductive contact areas 660 disposed in spaced relationship there along (FIG. 10A). The plunger 655 is held within the body 650 by end plates 673 attached to ends of the plunger 655 by bolts 670. End cover supports 680 are attached to the body 650 by means of screws 685. The end cover supports 680 may be bolted to the main body 505 of the delay valve 500 (FIG. 5B).

Figures 10B, 10D:
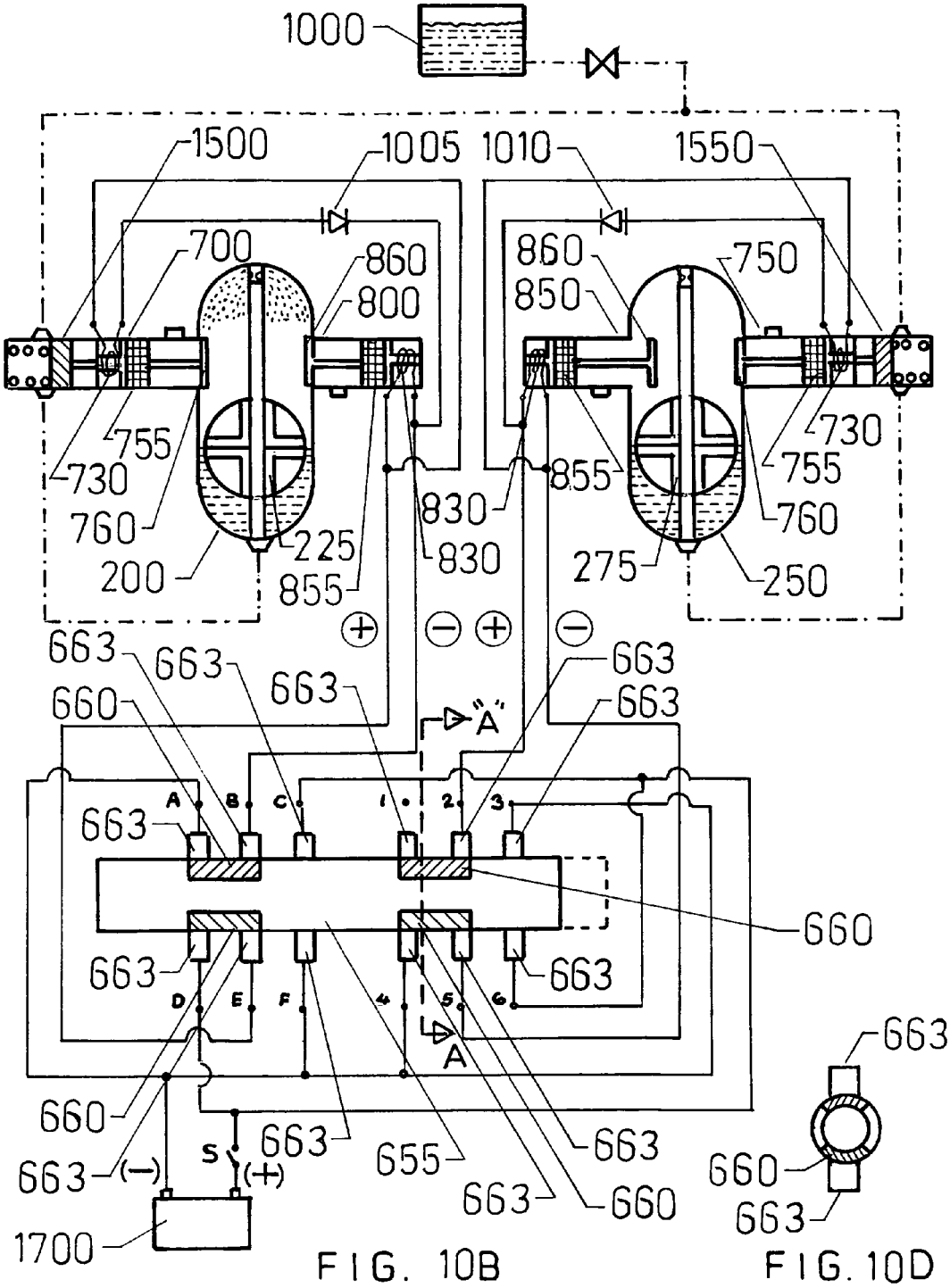
FIG. 10B is a schematic representation of the electrical system showing the delay valve actuated switch in a first position in accordance with the invention.
FIG. 10D is a cross sectional view of the plunger taken along line A-A of FIG. 10B.
Figure 11A:
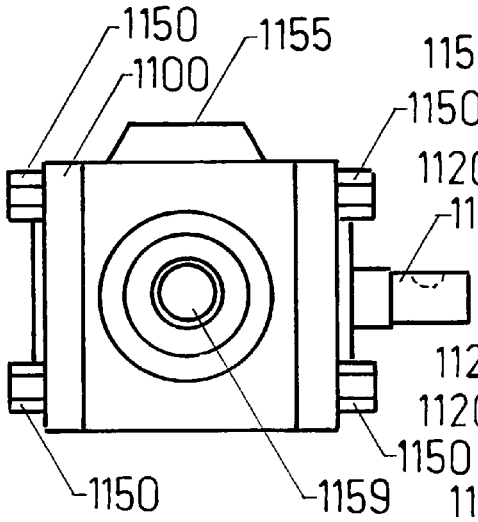
FIG. 11A is a side elevation view of a three-way valve in accordance with the invention.
Figure 11B:
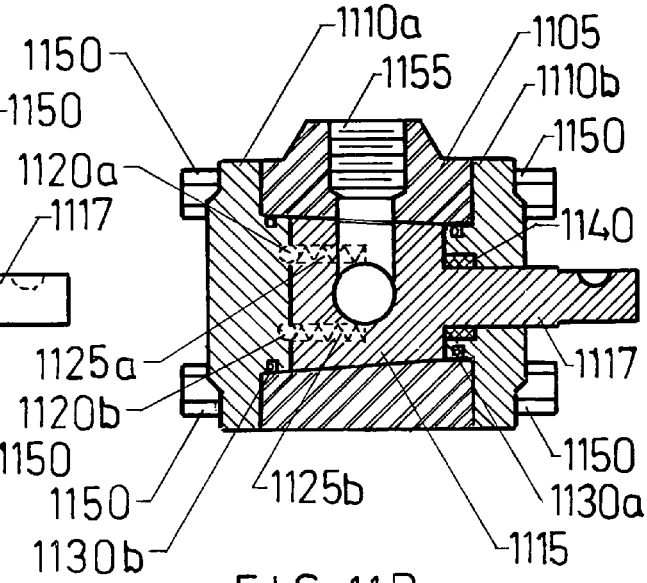
FIG. 11B is a cross sectional view of the three-way valve of FIG. 11A.
Figure 11C:
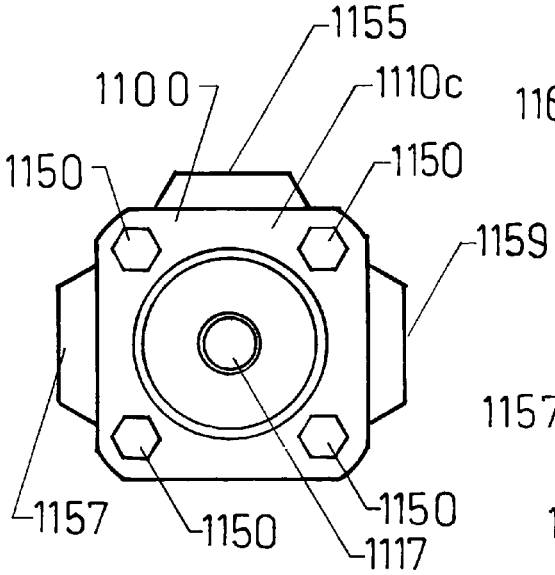
FIG. 11C is a front elevation view of the three-way valve of FIG. 11A.
Figure 11D:
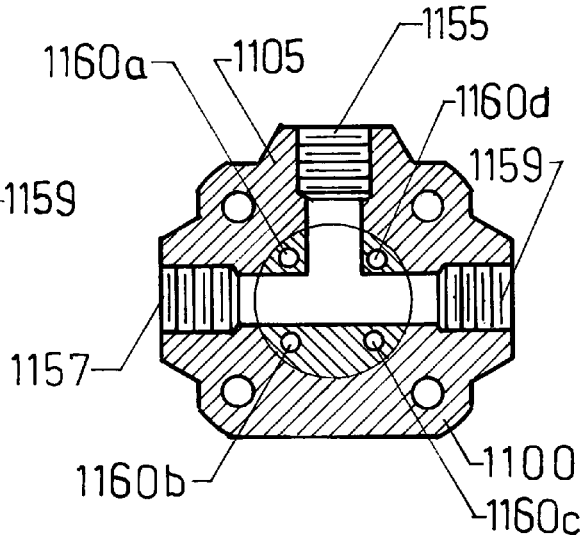
FIG. 11D is a cross sectional view of the three-way valve of FIG. 11C.

The plunger 655 includes a slot 620 sized to receive the push rod 690. Movement of the sliding connector 581 of the delay valve 500 to which the push rod 690 is attached is operable to move the plunger 655 between the first and second positions. Electrical switching is achieved by contact between brushes 663 and the conductive contact areas 660 as illustrated in FIG. 10A and FIG. 10B. Brushes 663 are housed beneath protective covers 675, held in place by screws 645, and urged toward the plunger 655 by springs 691. Electrical contact with the brushes 663 is provided by contacts 667. Wiring of the switch 600 to the exhaust valves 800 and 850 and to the air intake valves 700 and 750 will be described with reference to FIG. 10A and FIG. 10B.

With reference to FIG. 10A, the plunger 655 of the delay valve actuated switch 600 is shown in the second position. In the second position, conductive contact areas 660 electrically connect points B and C, points 2 and 3, points E and F and points 5 and 6. A DC current of a second polarity flows through the coil 830 of the exhaust valve 850 and closes the valve 860. The same DC current also flows through the coil 730 of the air intake valve 750 as a diode 1010 in the circuit is forward biased. Flow of the DC current of the second polarity is operable to close the valve 760.

Figure 15A:
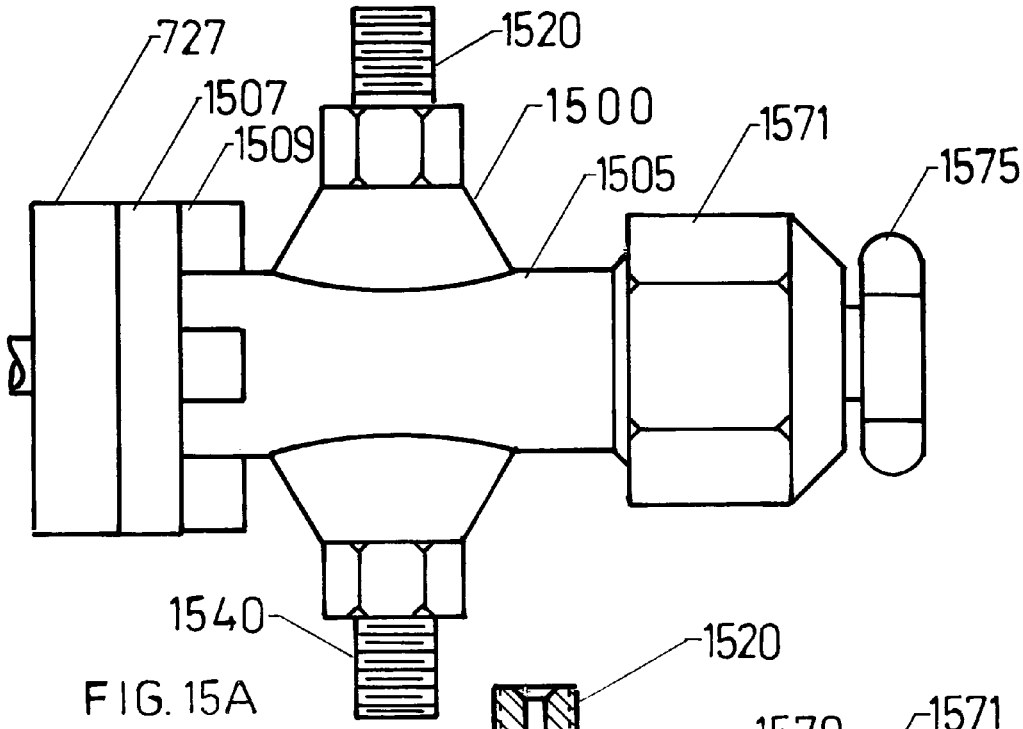
FIG. 15A is a side elevation view of a fuel pump in accordance with the invention.
Figure 15B:
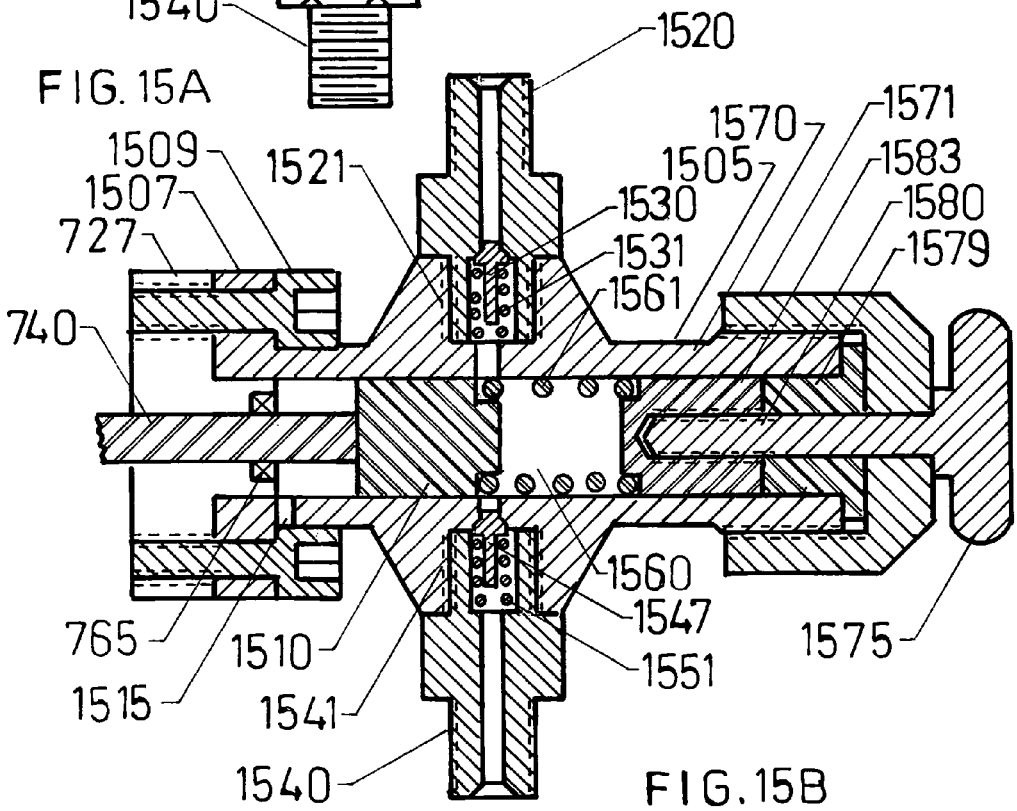
FIG. 15B is a cross sectional view of the fuel pump of FIG. 15A.

In the second position, a DC current of a first polarity flows through the coil 830 of the exhaust valve 800 and opens the valve 860. Furthermore, the valve 760 of the air intake valve 700 is open as a diode 1005 in the circuit is reverse biased and no current flows through the coil 730 of the air intake valve 700. As previously described, the valve 760 is urged open by the spring 1561 (FIG. 15B).

As previously described, in the second position rising hydraulic pressure causes an explosion in the second reaction chamber 250 that in turn causes the hydraulically actuated delay valve 500 to switch to the first position in which the flow of pressurized fluid is directed to the first reaction chamber 200.

Switching of the delay valve 500 causes the plunger 655 to switch to the first position as shown in FIG. 10B. In the first position, conductive contact areas 660 electrically connect points A and B, points 1 and 2, points D and E and points 4 and 5. DC current of the second polarity flows through the coil 830 of the exhaust valve 800 and closes the valve 860. The same DC current also flows through the coil 730 of the air intake valve 700 as the diode 1005 in the circuit is forward biased. Flow of the DC current of the second polarity is operable to close the valve 760.

In the first position, DC current of a first polarity flows through the coil 830 of the exhaust valve 850 and opens the valve 860. The valve 760 of the air intake valve 750 remains closed as the diode 1010 in the circuit is reverse biased and no current flows through the coil 730 of the air intake valve 750. As previously described, the valve 760 is urged open by the spring 1561 (FIG. 15B).

The Air Intake Valves

Figure 7A:
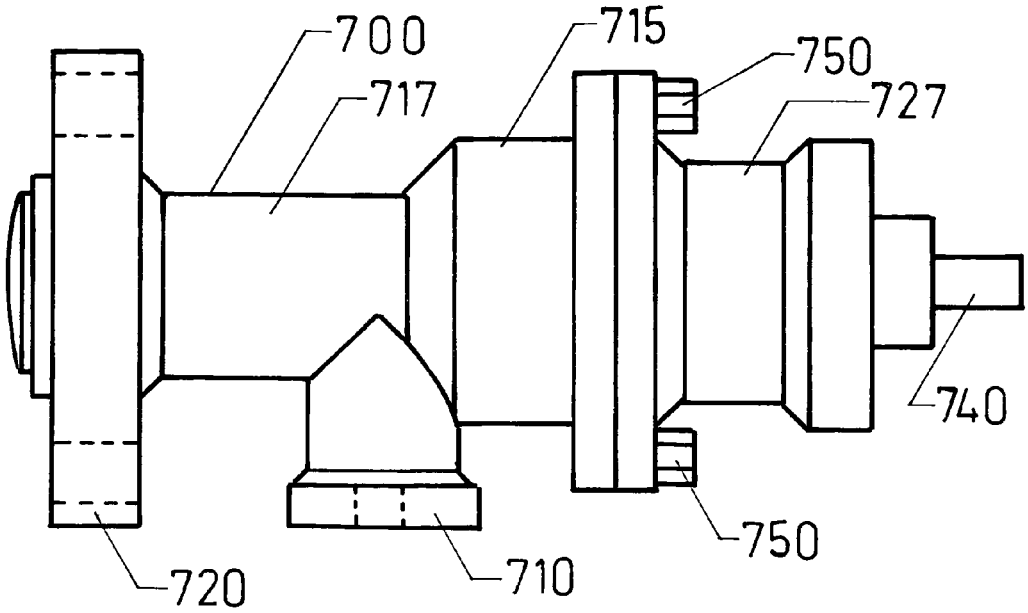
FIG. 7A is a side elevation view of an air intake valve in accordance with the invention.
Figure 7B:
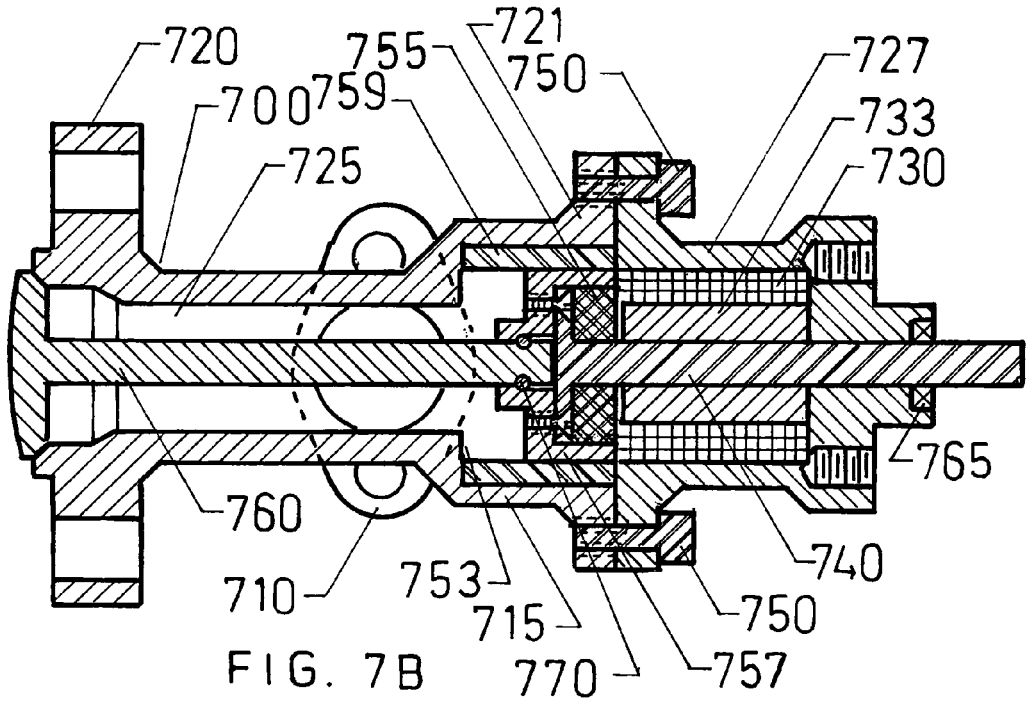
FIG. 7B is a cross sectional view of the air intake valve of FIG. 7A.

Air intake valves 700 and 750 are in all respects identical and only air intake valve 700 will be described. As shown in FIG. 7A and FIG. 7B, the air intake valve 700 includes a body 715 having an attachment end 720 and a flanged end 721. Attachment end 720 is attached to the flanged connection point 223 of the first reaction chamber 200. An end portion 727 is attached to the flanged end 721 by means of bolts 750.

The body 715 includes a coupling 710 for connection to a one and one quarter inch pipe F3 connected to the air pump 1200. As further described herein, the air pump 1200 provides a source of air to the air intake valves 700 and 750.

The end portion 727 includes a coil 730 electrically coupled to the switch 600 in surrounding relationship to a core material 733. The core material 733 surrounds a rod 740 sized to slid through the core material 733 in response to a current in the coil 730. The rod 740 is coupled at one end thereof to a non-conductive piston 757 disposed in the body 715. The other end of the rod 740 is coupled to the fuel pump 1500 (FIG. 15B). The piston 757 is slidingly fitted in the body 715 and moves between a first position in which current flows in the coil 730 (shown in FIG. 7B) and a second position against a shoulder 753 when no current flows in the coil 730. A permanent magnet 755 is coupled to the piston 757 for this purpose. A valve 760 is attached to the piston 757 and opens and closes the intake valve 700 in response to current in the coil 730.

The Exhaust Valves

Figure 8A:
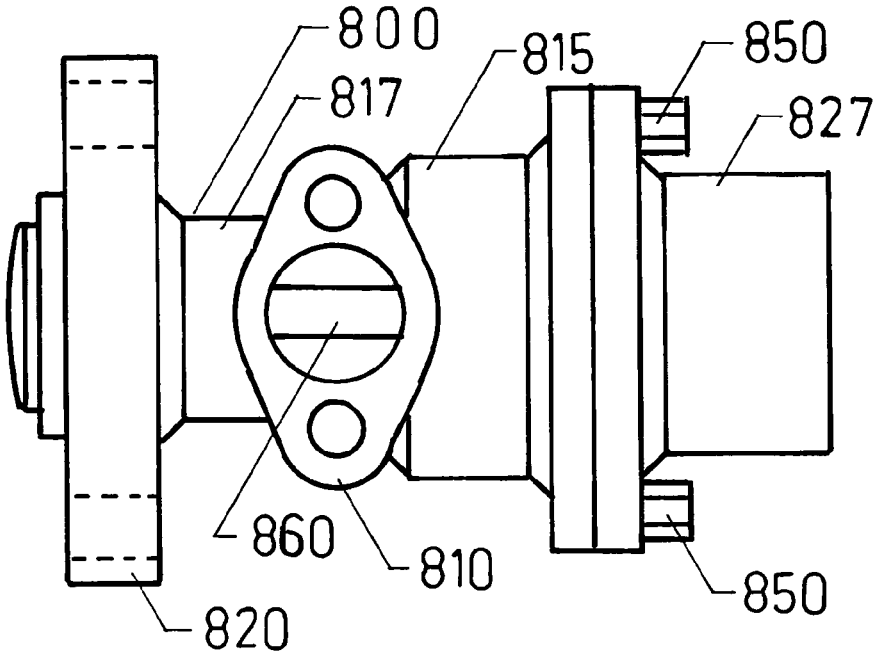
FIG. 8A is a side elevation view of an exhaust valve in accordance with the invention.
Figure 8B:
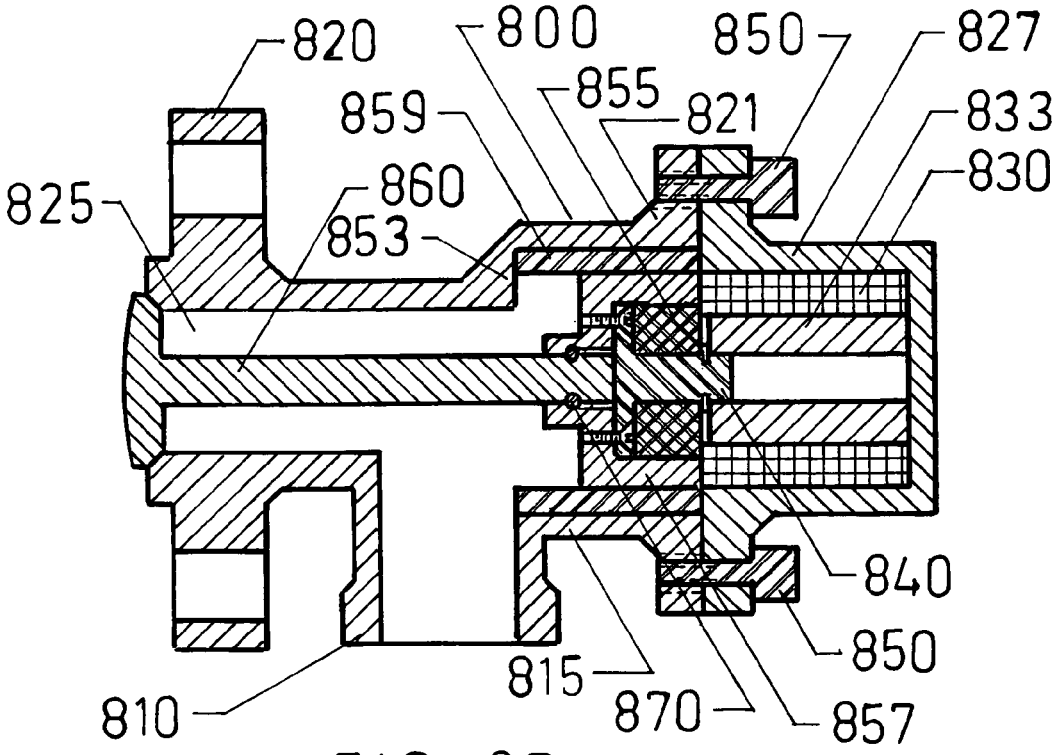
FIG. 8B is a cross sectional view of the exhaust valve of FIG. 8A.

Exhaust valves 800 and 850 are in all respects identical and only exhaust valve 800 will be described. As shown in FIG. 8A and FIG. 8B, the exhaust valve 800 includes a body 815 having an attachment end 820 and a flanged end 821. Attachment end 820 is attached to the flanged connection point 220 of the first reaction chamber 200. An end portion 827 is attached to the flanged end 821 by means of bolts 850.

The body 815 includes a coupling 810 for connection to a one and one quarter inch pipe F1 connected to the air pump 1200. As further described herein, the air pump 1200 is powered in part by exhaust gases exiting the from the first reaction chamber 200 through the coupling 810.

The end portion 827 includes a coil 830 electrically coupled to the switch 600 in surrounding relationship to a core material 833. A non-conductive piston 857 is disposed in the body 815. The piston 857 is slidingly fitted in the body 815 and moves between a first position in which current flows in the coil 830 in a first direction (shown in FIG. 8B) and a second position against a shoulder 853 when current flows in the coil 830 in a second direction. A permanent magnet 855 is coupled to the piston 857 for this purpose. A valve 860 is attached to the piston 857 and opens and closes the exhaust valve 800 in response to the current direction in the coil 830.

The Make-Up Tank

Figure 9A:
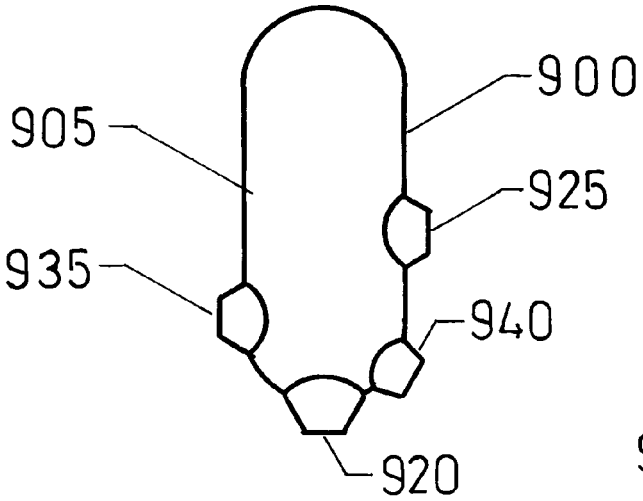
FIG. 9A is a side elevation view of a make-up tank in accordance with the invention.
Figure 9C:
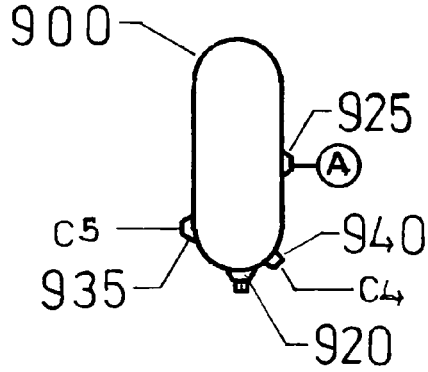
FIG. 9C is a schematic representation of the fittings of the make-up tank of FIG. 9A.
Figure 9B:
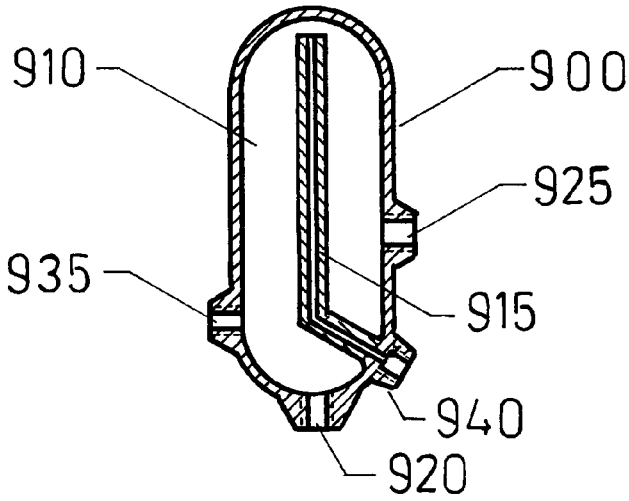
FIG. 9B is a cross sectional view of the make-up tank of FIG. 9A.

The make-up tank 900 is shown in FIG. 9A, FIG. 9B and FIG. 9C. The tank 900 includes a body 905 of generally cylindrical shape within which is an open enclosure 910. In use the make-up tank 900 is filled with hydraulic fluid to a level below a top of a pipe 915 disposed within the enclosure 910. Gas from the gas tank 1600, coupled to the make-up tank 900 through the second three-position valve 1150 at a coupling 940 connected to the half inch pipe C4, provides pressure to the hydraulic fluid through the pipe 915. A source of hydraulic fluid is in fluid communication with the enclosure 910 through an opening 935 formed in the body 905 and connected to the pipe C5. A low water alarm A is attached to an outlet 925. In the event of a low water condition in the make-up tank 900, water may be added by closing the three position valve 1150, opening the bleeder valve B-1 to release the pressure within the enclosure 910, closing the bleeder valve B-1 when water flows therethrough and opening the three position valve 1150 to pressurize the hydraulic fluid in the enclosure 910. A drain outlet 920 provides a means of draining the hydraulic fluid from the enclosure 910.

The Three Position Rotary Valves

Three position rotary valves 1100 and 1150 are in all respects identical in construction and only three position rotary valve 1100 will be described with reference to FIGS. 11A, 11B, 11C and 11D. Three position rotary valve 1100 includes a body 1105 and end plates 1110*a* and 1110*b* bolted thereto by bolts 1150. Disposed within the body 1105 is a three way cone valve 1115 positionable in alignment with three apertures 1155, 1157 and 1159 formed in the body 1105. Apertures 1155, 1157 and 1159 are connected to one inch pipes B7, B10 and B9 respectively. O-rings 1130*a* and 1130*b* disposed in the end plates 1110*a* and 1110*b* adjacent the body 1105 seal the three way cone valve 1115 within the body 1105. A mechanical seal 1140 disposed adjacent a three way cone valve shaft 1117 prevents fluid from escaping the three way cone valve 1115.

In order to position the three position rotary valve 1100, a positioning system includes spaced hemispherical indentations 1160*a*, 1160*b*, 1160*c* and 1160*d* formed in the end plate 1110*a*. Indentations 1160*a*, 1160*b*, 1160*c* and 1160*d* are sized to accept bearings 1120*a* and 1120*b* (other bearings not shown) disposed in the three way cone valve 1115 and urged by springs 1125*a* and 1125*b*.

The Air Pump

Figure 12A:
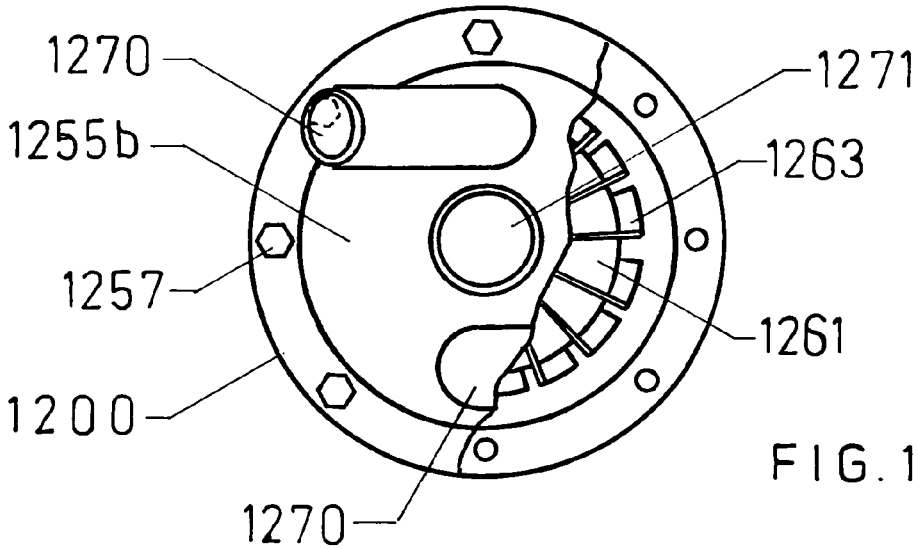
FIG. 12A is a top view in partial cross section of an air pump in accordance with the invention.
Figure 12B:
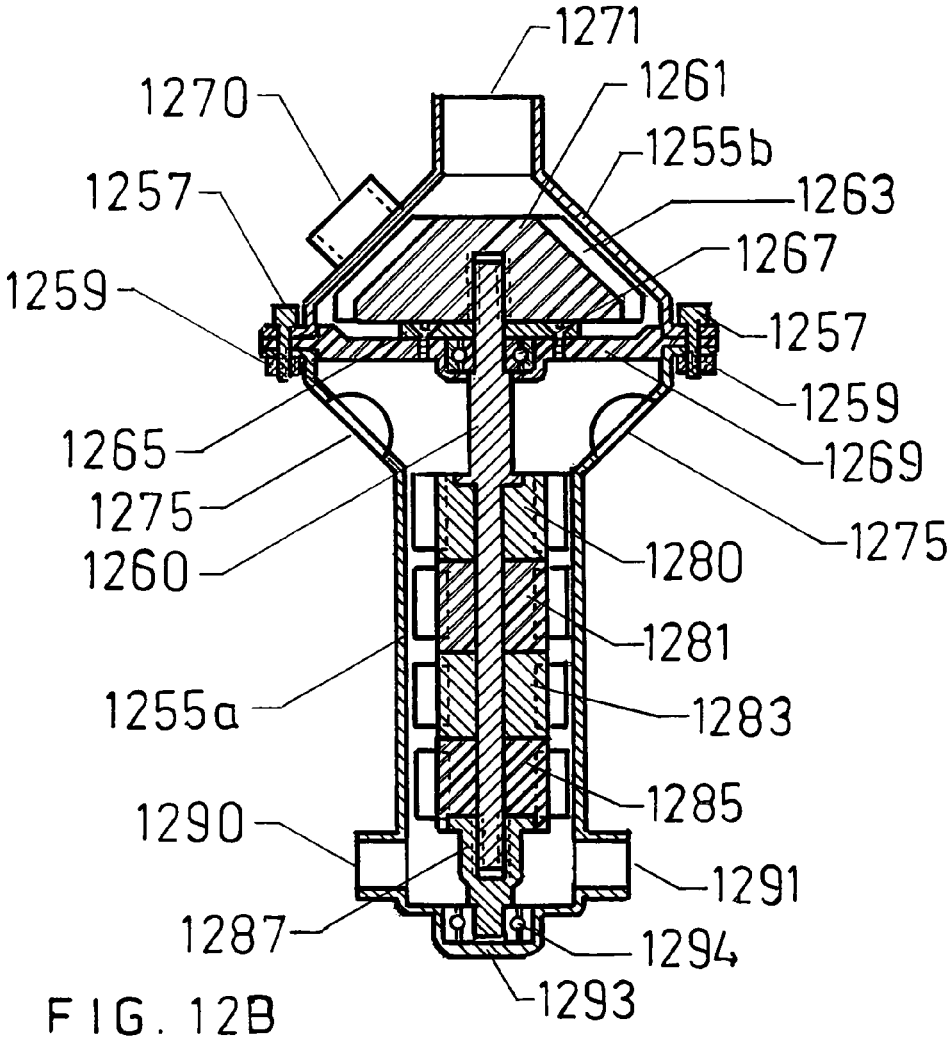
FIG. 12B is a cross sectional view of the air pump in accordance with the invention.

With reference to FIGS. 12A and 12B, the air pump 1200 is shown including a bottom portion 1255*a* and a top portion 1255*b* bolted together by means of bolts 1257 and nuts 1259. Two exhaust gas inlets 1270 are provided in fluid communication with the interior of the top portion 1255*b* in which are disposed fan blades 1263. Exhaust inlets 1270 connected to one and one quarter inch pipes F1 and F2 are coupled to exhaust valves 800 and 850. An exhaust gas outlet 1271 provides an escape for the exhaust gas.

The fan blades 1263 are attached to a rotor 1261 that extends from the top portion 1255*b* into the bottom portion 1255*a*. A bearing plate 1265 and bearings 1267 disposed in a bearing housing 1269 support rotation of the rotor 1261 in the top portion 1255*b*. At the opposite end of the rotor 1261, a bearing shaft nut 1287 and bearings 1294 disposed in a bearing housing 1293 support rotation of the rotor 1261 in the bottom portion 1255*a*.

Attached to the rotor 1261 is a rotor shaft 1260. Impellers 1280, 1281, 1283 and 1285 are attached to the rotor shaft 1260 in the bottom portion 1255*a*. Rotation of the fan blades 1263 and rotor 1261 produced by flow of exhaust gasses in the top portion 1255*b*, causes rotation of the impellers 1280, 1281, 1283 and 1285 in the bottom portion 1255*a*. Rotation of the impellers 1280, 1281, 1283 and 1285 in turn draws air into air inlets 1275 and forces the air to exit air outlets 1290 and 1291. Air outlet 1290 is coupled to the air intake valve 700 by a one and one quarter inch pipe F3 and the air outlet 1291 is coupled to the air intake valve 750 by a one and one quarter inch pipe F4.

The Shut-Off Valve

Figure 13B:
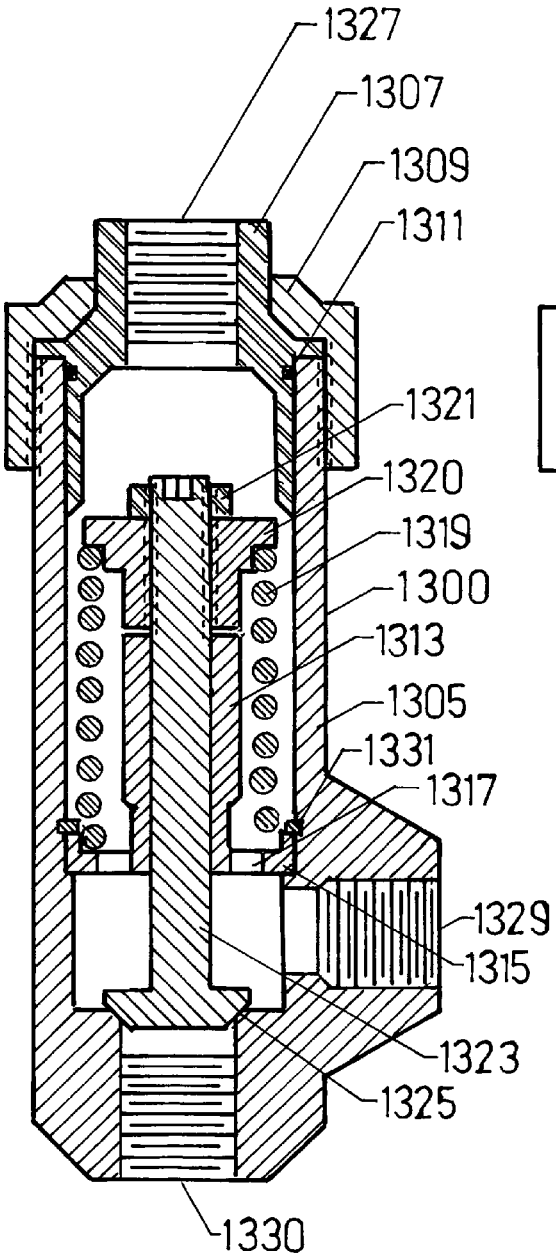
FIG. 13B is a cross sectional view of the shut off valve of FIG. 13A.
Figure 13A:
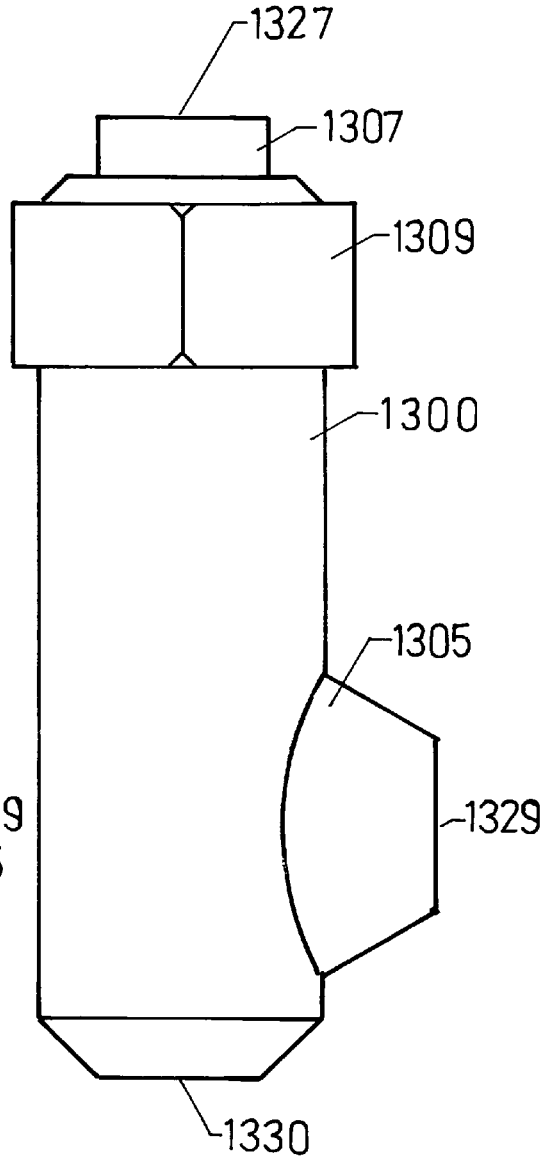
FIG. 13A is a side elevation view of a shut off valve in accordance with the invention.

The shut-off valve 1300 shown in FIG. 13A and FIG. 13B includes an elongate body 1305 having a side opening 1329 and a bottom opening 1330. A cover 1307 including an opening 1327 is attached to the top of the body 1305 by means of a nut 1309. An O-ring 1311 prevents fluid from escaping the cover 1307.

A valve assembly disposed within the body 1305 includes a valve 1323 having a threaded first end to which is attached a piston 1320. Piston 1320 is secured to the valve 1323 by means of a locking nut 1321. A valve liner1313 is attached to the body 1305 and locked in place by a lock ring 1331. A valve seat portion 1325 seats to close fluid flow through the shut-off valve 1300. A spring 1319 is disposed within the body 1305 and urges the valve assembly upward within the cover 1307.

Spring 1319 rests at one end against a shoulder portion 1315 and at the other end against the piston 1320.

The shut-off valve 1300 is normally open and is open during operation of the hydraulic engine 100 allowing flow of pressurized fluid through the shut-off valve 1300 from the pressure tank 400 to the delay valve 500.

When the hydraulic engine 100 is stopped, increased fluid pressure exerted upon the piston 1320 urges the valve assembly downward to close the shut-off valve 1300 and prevent flow of pressurized fluid from the pressure tank 400 to the delay valve 500.

The Bypass Valve

Figure 14A:
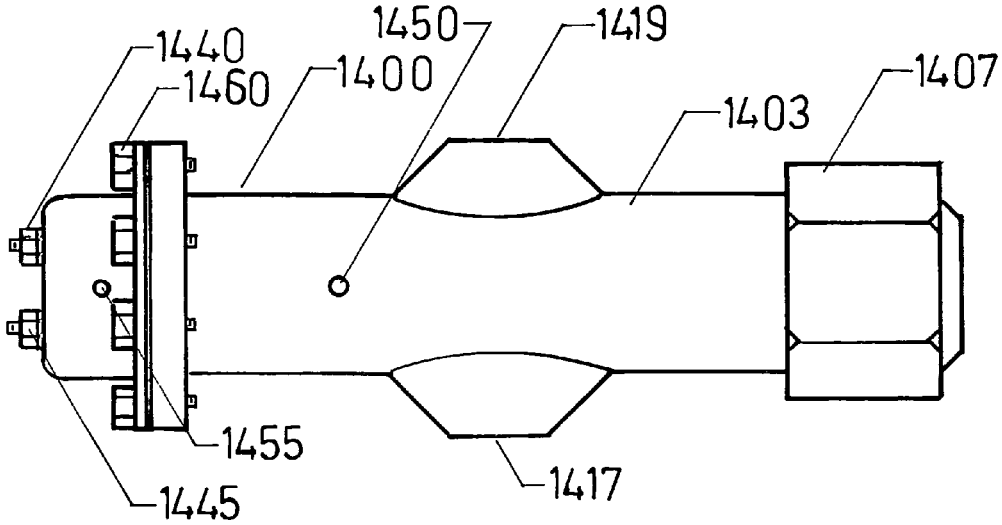
FIG. 14A is a side elevation view of a bypass valve in accordance with the invention.
Figure 14B:
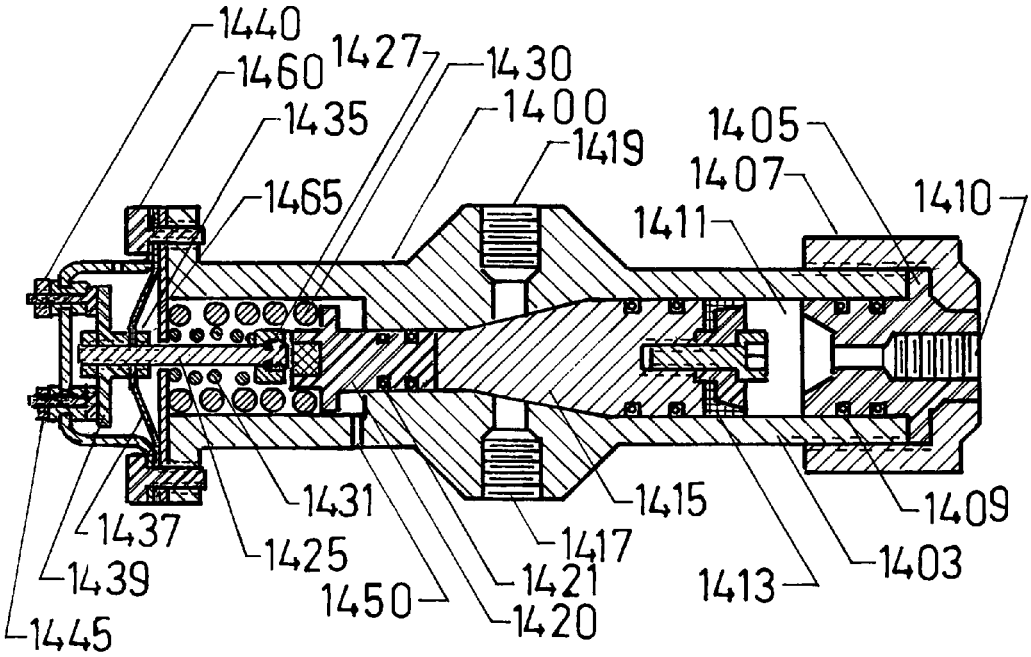
FIG. 14B is a cross sectional view of a bypass valve of FIG. 14A.

Bypass valve 1400 is shown in FIGS. 14A and 14B and includes an elongated body 1403 having end openings capped by a cover 1405 on one end and a piston 1420 at the other end. Elongated body 1403 further includes a pair of opposed threaded openings 1419 and 1417 disposed at a midsection thereof.

Cover 1405 is held in place by a nut 1407 and includes a threaded opening 1410. Threaded opening 1410 is in fluid communication with an anterior chamber 1411 in which pressurized fluid exerts pressure upon a hydraulic cup 1413 affixed to an end of a piston 1415. Movement of the piston 1415 is constrained by a narrow portion of the anterior chamber 1411.

Piston 1420 is urged against another end of the piston 1415 by a spring 1430. A rod 1425 disposed within the elongated body 1403 is attached to a conductor 1439 that connects contacts 1440 and 1445 when the rod 1425 is in a first position (shown in FIG. 14B). A diaphragm 1437 is attached to the rod 1425 and prevents moisture from reaching the contacts 1440 and 1445. A spring 1431 urges the rod 1425 to disconnect the contacts 1440 and 1445 in a second position.

During operation of the hydraulic engine 100, the piston 1415 is forced into the narrow portion of the anterior chamber 1411 closing threaded openings 1419 and 1417. When the hydraulic engine 100 is shut down, pressure is relieved upon the hydraulic cup 1413 and the spring 1430 urges the pistons 1420 and 1415 such that threaded openings 1419 and 1417 are brought into fluid communication and pressure is equalized between the reaction chambers 200 and 250.

The Fuel Pumps

Fuel pump 1500 and 1550 are in all respects identical in construction and only fuel pump 1500 will be described with reference to FIG. 15A and FIG. 15B. As previously described, fuel pump 1500 is coupled to air intake valve 700 and actuated by piston 740.

Fuel pump 1500 includes a body 1505 one end 1507 of which is bolted to the air intake valve 700 by means of bolts 1509. An inlet check valve fitting 1520 is screwed into a threaded opening 1521. Inlet check valve fitting 1520 includes a valve 1530 urged closed by a spring 1531.

An outlet check valve fitting 1540 is screwed into a threaded opening 1541 and includes a valve 1547 urged closed by a spring 1551. Movement of a piston 1510 coupled to the piston 740 opens and closes valves 1530 and 1547 to draw fuel into and out of an interior chamber 1560 filled with fuel.

An end 1570 of the body 1505 includes a cover 1579 held in place by a nut 1571. A plunger 1580 is disposed within the interior chamber 1560 and is screwed into a piston 1583. By unscrewing the plunger 1580 and loosening the inlet check valve fitting 1520, the fuel pump is primed by pumping the plunger using a manual handle 1575. When no air escapes the interior chamber 1560, the inlet check valve fitting 1520 and the plunger 1580 are tightened. The piston 1510 is urged by a spring 1561 against the piston 1583 to push the rod 740 and thereby open the air intake valve 700 when no current is flowing to the coil 730 of the air intake valve 700.

Operation

Prior to operation, the hydraulic engine 100 is initialized as follows. Valve 1150 is set to a first position providing fluid communication between a line C2 coupled to the Ni gas tank 1600 and a line C3 coupled to the pressure tank 400. Valve 1605 is closed so that the pressure tank 400 is initially not pressurized.

Valve 1100 is next set to a reset position providing fluid communication between the shut off valve 1300 and the impulse turbine return line B7. Valve 1100 and the shut off valve 1300 are hydraulically coupled by means of line B9.

A water supply line C5 is connected to the hydraulic engine 100 to provide water to the pressure tank 400 and to the make-up tank 900. Pressure in the water supply line C5 is preferably between 10 and 15 psi. The make-up tank 900 is filled with water by opening a bleeder valve B-1 until water is detected. When water is detected, the valve B-1 is closed. The pressure tank 400 is then filled with water by opening the bleeder valve B-2 until water is detected. Valve B-2 is then closed.

Next the valve 1605 is opened and a pressure regulator 1610 set to provide 20 psi pressure to the pressure tank 400.

To provide water to the components of the hydraulic engine 100, the valve 1100 is set to a start position in which the pressure tank 400 is in fluid communication with the shut off valve 1300 through the lines B9 and B10 and the impulse turbine return line B7. The shut off valve 1300 is normally open to allow the flow of water from the impulse turbine 300 (lines B7 and B8) to the delay valve 500 through lines B4 and B3.

By opening bleeder valve B-3, the impulse turbine 300 is bled of air. Bleeder valve B-3 is closed when water is detected. In similar fashion, bleeder valve B-4 is opened to bleed the reaction chambers 200 and 250 of air. When water is detected at bleeder valve B-4, the valve 1100 is set to a reset position to interrupt water flow from the pressure tank 400. Bleeder valve B-4 is closed when water is no longer detected. The hydraulic engine 100 now has the required water levels in all of its components and is ready for operation.

The bleeder valve B-5 is next opened to adjust the water level in the pressure tank 400. When no water is detected, the bleeder valve B-5 is closed.

The pressure regulator valve 1610 is next adjusted to provide a high pressure to the water in the pressure tank 400. The pressure is sufficient to enable the ignition of the fuel/air mixture at an ignition temperature of the mixture in each reaction chamber.

The fuel pumps 1500 and 1550 are next bled of air by unscrewing the manual push rods (1580 in the case of fuel pump 1500) and the inlet check valve fitting 1520. The push rods are pushed back and forth until no air remains inside the fuel pump and fuel lines. Inlet check valve fitting 1520 and the push rods are then screwed tight.

To start operation of the hydraulic engine 100, the valve 1150 is turned to a second position. In this position, the gas tank 1600 is in fluid communication with the water make-up tank 900. As water is lost in the pressure tank 400, water from the make-up tank 900 flows to the pressure tank 400 through line C5.

Valve 1100 is then set to the start position and the hydraulic engine 100 starts operation.

To stop the hydraulic engine 100, the valve 1100 is set to the stop position.

To restart the hydraulic engine 100, the valve 1100 is first set to the reset position then set to the start position.

The hydraulic engine in accordance with the invention provides an efficient engine capable of using a variety of fuels. The hydraulic engine is easy to maintain as it comprises few moving parts. Furthermore, no cooling system is required and lubrication is only required for the impulse engine bearings. Floating pistons require no lubrication and provide more efficient energy conversion.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A hydraulic engine comprising:

first and second reaction chambers, the first and second reaction chambers each having an enclosure within which is disposed a floating piston;

an impulse turbine in fluid communication with the first and second reaction chambers;

a delay valve in fluid communication with the first and second reaction chambers and the impulse turbine, the delay valve operable to switch between a first position and a second position, the first position providing a flow of pressurized fluid to the first reaction chamber to cause an explosion therein and the second position providing a flow of pressurized fluid to the second reaction chamber to cause an explosion therein, successive explosions in the first and second reaction chambers providing flows of high pressure fluid to drive the impulse turbine and to switch the delay valve; and a pressure tank in fluid communication with the first and second reaction chambers, the impulse turbine and the delay valve, the pressure tank providing pressurized fluid to the first and second reaction chambers, the impulse turbine and the delay valve.

2. The hydraulic engine of claim 1, further comprising a source of fuel coupled to the first and second reaction chambers.

3. The hydraulic engine of claim 1 further comprising:

an exhaust valve and an air intake valve coupled to the first reaction chamber;

an exhaust valve and an air intake valve coupled to the second reaction chamber;

a fuel pump coupled to the first reaction chamber;

a fuel pump coupled to the second reaction chamber; and a delay valve actuated switch mechanically coupled to the delay valve, the delay valve actuated switch operable to switch the exhaust and air intake valves and the fuel pumps.

4. The hydraulic engine of claim 3, wherein the delay valve actuated switch is operable to switch between a first and a second position corresponding to the first and second positions of the delay valve, the delay valve actuated switch first position providing a DC current to open the second reaction chamber exhaust valve and a DC current to close the first reaction chamber exhaust and air intake valves, and the delay valve actuated switch second position providing a DC current to open the first reaction chamber exhaust valve and a DC current to close the second reaction chamber exhaust and air intake valves.

5. The hydraulic engine of claim 3, further comprising an air pump coupled to the first and second reaction chamber exhaust valves and to the first and second reaction chamber air intake valves, exhaust gases exiting the first and second reaction chambers driving a plurality of air pump fan blades that in turn drive a plurality of air pump impellers to provide air to the first and second reaction chamber air intake valves.

6. The hydraulic engine of claim 3, further comprising a normally open shut-off valve in fluid communication with the pressure tank, the delay valve and an impulse turbine return line.

7. The hydraulic engine of claim 6, further comprising a three position rotary valve in fluid communication with the pressure tank, the normally open shut-off valve and the impulse turbine return line.

8. The hydraulic engine of claim 6, further comprising a bypass valve in fluid communication with the first and second reaction chambers and the normally open shut-off valve.

9. The hydraulic engine of claim 3, further comprising a make-up tank in fluid communication with the pressure tank.

10. The hydraulic engine of claim 9, further comprising a three position rotary valve in fluid communication with the make-up tank, the pressure tank and a source of gas.

11. A hydraulic engine comprising:

first and second reaction chambers, the first and second reaction chambers each having an enclosure within which is disposed a floating piston;

an exhaust valve and an air intake valve coupled to the first reaction chamber;

an exhaust valve and an air intake valve coupled to the second reaction chamber;

a fuel pump coupled to the first reaction chamber;

a fuel pump coupled to the second reaction chamber;

an impulse turbine in fluid communication with the first and second reaction chambers;

a delay valve in fluid communication with the first and second reaction chambers and the impulse turbine, the delay valve operable to switch between a first position and a second position, the first position providing a flow of pressurized fluid to the first reaction chamber to cause an explosion therein and the second position providing a flow of pressurized fluid to the second reaction chamber to cause an explosion therein, successive explosions in the first and second reaction chambers providing flows of high pressure fluid to drive the impulse turbine and to switch the delay valve;

a delay valve actuated switch mechanically coupled to the delay valve, the delay valve actuated switch operable to switch the exhaust and air intake valves and the fuel pumps coupled to the first and second reaction chambers; and a pressure tank in fluid communication with the first and second reaction chambers, the impulse turbine and the delay valve, the pressure tank providing pressurized fluid to the first and second reaction chambers, the impulse turbine and the delay valve.

12. The hydraulic engine of claim 11, further comprising a source of fuel coupled to the first and second reaction chamber fuel pumps.

13. The hydraulic engine of claim 11, wherein the delay valve actuated switch is operable to switch between a first and a second position corresponding to the first and second positions of the delay valve, the delay valve actuated switch first position providing a DC current to open the second reaction chamber exhaust valve and a DC current to close the first reaction chamber exhaust and air intake valves, and the delay valve actuated switch second position providing a DC current to open the first reaction chamber exhaust valve and a DC current to close the second reaction chamber exhaust and air intake valves.

14. The hydraulic engine of claim 11, further comprising an air pump coupled to the first and second reaction chamber exhaust valves and to the first and second reaction chamber air intake valves, exhaust gases exiting the first and second reaction chambers driving a plurality of air pump fan blades that in turn drive a plurality of air pump impellers to provide air to the first and second reaction chamber air intake valves.

15. The hydraulic engine of claim 11, further comprising a normally open shut-off valve in fluid communication with the pressure tank, the delay valve and an impulse turbine return line.

16. The hydraulic engine of claim 15, further comprising a three position rotary valve in fluid communication with the pressure tank, the normally open shut-off valve and the impulse turbine return line.

17. The hydraulic engine of claim 15, further comprising a bypass valve in fluid communication with the first and second reaction chambers and the normally open shut-off valve.

18. The hydraulic engine of claim 11, further comprising a make-up tank in fluid communication with the pressure tank.

19. The hydraulic engine of claim 18, further comprising a three position rotary valve in fluid communication with the make-up tank, the pressure tank and a source of gas.

20. A hydraulic engine comprising:

first and second reaction chambers, the first and second reaction chambers each having an enclosure within which is disposed a floating piston;

an exhaust valve and an air intake valve coupled to the first reaction chamber;

an exhaust valve and an air intake valve coupled to the second reaction chamber;

a fuel pump coupled to the first reaction chamber;

a fuel pump coupled to the second reaction chamber;

an impulse turbine in fluid communication with the first and second reaction chambers;

a delay valve in fluid communication with the first and second reaction chambers and the impulse turbine, the delay valve operable to switch between a first position and a second position, the first position providing a flow of pressurized fluid to the first reaction chamber to cause an explosion therein and the second position providing a flow of pressurized fluid to the second reaction chamber to cause an explosion therein, successive explosions in the first and second reaction chambers providing flows of high pressure fluid to drive the impulse turbine and to switch the delay valve;

a delay valve actuated switch mechanically coupled to the delay valve, the delay valve actuated switch operable to switch the exhaust and air intake valves and the fuel pumps coupled to the first and second reaction chambers and wherein the delay valve actuated switch is operable to switch between a first and a second position corresponding to the first and second positions of the delay valve, the delay valve actuated switch first position providing a DC current to open the second reaction chamber exhaust valve and a DC current to close the first reaction chamber exhaust and air intake valves, and the delay valve actuated switch second position providing a DC current to open the first reaction chamber exhaust valve and a DC current to close the second reaction chamber exhaust and air intake valves; and a pressure tank in fluid communication with the first and second reaction chambers, the impulse turbine and the delay valve, the pressure tank providing pressurized fluid to the first and second reaction chambers, the impulse turbine and the delay valve.

* * * * *